US008453403B2

(12) United States Patent
Wheeler

(10) Patent No.: US 8,453,403 B2
(45) Date of Patent: Jun. 4, 2013

(54) APPARATUS AND METHODS OF FORMING A CURVED STRUCTURE

(75) Inventor: Frank L. Wheeler, Oklahoma City, OK (US)

(73) Assignee: Flex-Ability Concepts, L.L.C., Oklahoma City, OK (US)

( * ) Notice: Subject to any disclaimer, the term of this patent is extended or adjusted under 35 U.S.C. 154(b) by 418 days.

(21) Appl. No.: 12/306,196

(22) PCT Filed: Jun. 28, 2007

(86) PCT No.: PCT/US2007/015082

§ 371 (c)(1),
(2), (4) Date: Dec. 22, 2008

(87) PCT Pub. No.: WO2008/002658

PCT Pub. Date: Jan. 3, 2008

(65) Prior Publication Data

US 2009/0183460 A1 Jul. 23, 2009

Related U.S. Application Data

(60) Provisional application No. 60/816,951, filed on Jun. 28, 2006.

(51) Int. Cl.
*E04H 1/00* (2006.01)
*E04B 1/00* (2006.01)
*E04G 21/00* (2006.01)

(52) U.S. Cl.
USPC ..... 52/246; 52/241; 52/745.07

(58) Field of Classification Search
USPC ..... 52/745.07, 745.11, 745.17, 745.14, 52/245, 246, 241; 403/83, 103, 104, 110
See application file for complete search history.

(56) References Cited

U.S. PATENT DOCUMENTS

| | | | | |
|---|---|---|---|---|
| 689,894 | A | 12/1901 | Lutz | |
| 1,170,188 | A | 2/1916 | Ramussen et al. | |
| 1,714,174 | A | 5/1929 | Lichtenberg et al. | |
| 1,787,167 | A * | 12/1930 | Purdy | 403/58 |
| 1,901,789 | A | 3/1933 | Wimberley | |

(Continued)

FOREIGN PATENT DOCUMENTS

EP 1 464 770 A1 6/2004

OTHER PUBLICATIONS

Brochure of United States Gypsum Company entitled "Interior Remodeling Systems" (1987).

(Continued)

*Primary Examiner* — William Gilbert
*Assistant Examiner* — Elizabeth A Plummer
(74) *Attorney, Agent, or Firm* — McAfee & Taft

(57) ABSTRACT

An improved apparatus for forming curved structures comprises a plurality of pivotally connected sections, each section having a track portion, and a strap member adapted for slidably engaging the track portion of the sections such that the sections are movable to form a radius of curvature. The sections of the apparatus of the current invention are initially pivotal in relation to one another. Following position in a desired configuration, one embodiment of the current invention provides a tab or protrusion carried by one section which is compressed against the base portion of an adjacent section to preclude further pivotal movement. In another embodiment, the pivotal connection between adjacent sections is further compressed, crimped or swaged to preclude further pivotal movement.

41 Claims, 22 Drawing Sheets

U.S. PATENT DOCUMENTS

| | | | | | |
|---|---|---|---|---|---|
| 2,419,321 | A | | 4/1947 | Lopes | |
| 2,635,281 | A | | 4/1953 | Feldberg | |
| 3,053,358 | A | | 9/1962 | Gross | |
| 3,263,388 | A | | 8/1963 | Bogert | |
| 3,260,022 | A | | 7/1966 | Guyer et al. | |
| 3,295,269 | A | | 1/1967 | Schuster | |
| 3,505,714 | A | | 4/1970 | Boileau | |
| 3,772,875 | A | * | 11/1973 | Viano | 59/78.1 |
| 3,781,914 | A | | 1/1974 | Ramsey | |
| 3,999,352 | A | | 12/1976 | Doke | |
| 4,263,761 | A | | 4/1981 | Kristoff | |
| 4,311,293 | A | * | 1/1982 | Tenniswood | 248/49 |
| RE31,234 | E | | 5/1983 | Jureit et al. | |
| 4,470,239 | A | | 9/1984 | Sauer | |
| 4,483,120 | A | | 11/1984 | Gottlieb | |
| 4,496,100 | A | | 1/1985 | Schwager et al. | |
| 4,499,720 | A | * | 2/1985 | Klein | 59/78.1 |
| 4,544,094 | A | | 10/1985 | Scholey | |
| 4,562,683 | A | | 1/1986 | Gottlieb | |
| 4,593,710 | A | | 6/1986 | Stafford et al. | |
| 4,625,507 | A | * | 12/1986 | Moritz et al. | 59/78.1 |
| 4,631,894 | A | | 12/1986 | Jerila | |
| 4,773,503 | A | | 9/1988 | Purkapile | |
| 4,805,364 | A | | 2/1989 | Smolik | |
| 4,887,397 | A | | 12/1989 | Peterson | |
| 4,894,962 | A | | 1/1990 | Conn | |
| 5,048,283 | A | * | 9/1991 | Moritz et al. | 59/78.1 |
| 5,090,170 | A | | 2/1992 | Propst | |
| 5,094,059 | A | | 3/1992 | Ganescu | |
| 5,291,717 | A | | 3/1994 | Turner | |
| 5,394,665 | A | | 3/1995 | Johnson | |
| 5,553,961 | A | | 9/1996 | Olden | |
| 5,819,492 | A | | 10/1998 | Konicek | |
| 6,000,181 | A | * | 12/1999 | Wheeler | 52/241 |
| 6,625,942 | B1 | | 9/2003 | Wheeler | |
| 6,634,152 | B1 | | 10/2003 | Pilkintn | |
| 6,637,173 | B1 | | 10/2003 | Wheeler | |
| 7,073,299 | B1 | * | 7/2006 | diGirolamo et al. | 52/241 |
| 7,159,365 | B2 | * | 1/2007 | Cohen | 52/245 |
| 7,210,271 | B2 | * | 5/2007 | Wheeler | 52/245 |
| 7,293,392 | B2 | * | 11/2007 | Krumbacher | 52/241 |
| 7,458,188 | B2 | | 12/2008 | Mears | |
| 7,877,978 | B2 | * | 2/2011 | Heppner et al. | 59/78.1 |

OTHER PUBLICATIONS

Brochure of the Flex Trim Group entitled "The Flex Track System"—1 page.

Ray Clark, Construction Reference Manual entitled "Commercial Metal Stud Framing"—1999, pp. 10-15.

Flex-Ability Concepts Seminar entitled "Creating Custom Curves: Adding Interest to Architectural Designs"—2004.

* cited by examiner

APPARATUS AND METHODS OF FORMING A CURVED STRUCTURE

CROSS-REFERENCE TO RELATED APPLICATIONS

Priority is claimed from U.S. Provisional Patent Application Ser. No. 60/816,951, entitled "APPARATUS AND METHODS OF FORMING A CURVED STRUCTURE" filed Jun. 28, 2006, the contents of which are incorporated herein by reference.

BACKGROUND OF THE INVENTION

This invention relates generally to the field of construction and more particularly, but not by way of limitation, to methods and apparatus for forming curved structures, such as curved walls, archways, barrel ceilings and round columns.

Typically, straight wall construction uses a runner attached to the floor structure and a corresponding runner attached to the ceiling structure (or free floating) with studs positioned between and attached to the runners. The runners and studs form a structural frame suitable for supporting gypsum board, such as SHEETROCK™, or other wall covering. Construction of other straight line structures relies on these same principles. Common construction practices use wooden 2×4's and 2×6's (approximate dimensions of boards in inches) to form the runners and studs. However, steel runners and studs are gaining acceptance in both commercial construction as well as in residential construction.

These standard materials and methods are suitable for a major portion of most construction, however, curved structures, such as curved walls, archways, barrel ceilings and round columns are frequently desired for their architectural styling. While the principles for constructing curved structures are much the same as those for constructing straight structures, formation of such structures typically requires significantly more cuts in the runners and studs to form the desired radius. As a result, several track designs formed from sheet metal have been developed to reduce the amount of labor and waste associated with the construction of curved structures. While the sheet metal runners have been accepted as improvements over standard construction techniques, many are unwieldy and are difficult to position and retain in a desired position.

Thus, there is a need for improved methods and apparatus of forming a curved structure which provide adequate strength, minimal labor requirements, cost efficiency and flexibility in application. In particular, there is a need for methods and apparatus which may be readily formed and retained in a desired radius.

SUMMARY OF THE INVENTION

The present invention provides improved apparatus and methods of forming a curved structure which meet the needs described above.

The current invention provides an apparatus suitable for constructing curved walls, archways and other similar structures. The apparatus of the current invention comprises a plurality of sections wherein each section has a base portion with at least one slot. The sections are pivotally linked, i.e., joined to one another. As such, the sections may be integrally formed or may be formed separately and joined to each other in a manner known to those skilled in the art. Each base portion carries at least one upwardly projecting member. The upwardly projecting member of one base portion projects through the slot of an adjacent base portion. Bending or compressing the upwardly projecting member against the base portion precludes further pivotal movement between the adjacent sections.

In another embodiment of the current invention, the base portion of each section has at least two arcuate slots. Additionally, the sections are pivotally joined in a manner which provides a pivot point located between the arcuate slots. Preferably, each base portion carries at least one tab projecting through each arcuate slot of an adjacent based portion.

In a further embodiment, the current invention provides an apparatus for constructing curved structures wherein the apparatus comprises a plurality of sections with each section having a base portion carrying an eyelet, an eyelet receiving hole and at least one slot. The plurality of sections are pivotally joined to one another by positioning and pivotally securing the eyelet of one base portion within the eyelet receiving hole of an adjacent base portion. Additionally, each base portion carries at least one tab projecting through the slot of an adjacent base portion. Preferably, each base portion carries at least two arcuate slots and the pivot point resulting from the assembly of the eyelet with the eyelet receiving hole is located between the arcuate slots. Typically, the arcuate slots are generally concentric with the pivot point.

In yet another embodiment, the current invention provides an apparatus for constructing curved structures. The apparatus comprises a plurality of sections wherein each section has a base portion having at least one serrated slot. The sections of the apparatus are pivotally joined to one another. Additionally, the base portion of each section carries a deformable protrusion extending upward from the base portion. The deformable protrusion is positioned on the base portion at a location such that it extends upward through the serrated slot of an adjacent base portion. Subsequent deformation of the protrusion will lock the adjacent sections in place thereby precluding further pivotal movement between the adjacent sections.

Another embodiment of the current invention provides an apparatus for constructing curved structures wherein the apparatus comprises a plurality of sections with each section having a base portion. The sections are pivotally joined to one another and have a pivot point located between at least two arcuate serrated slots. Preferably, the pivotal link between adjacent sections is formed by pivotally securing an eyelet carried by one base portion in an eyelet receiving hole carried by an adjacent base portion. The serrated arcuate slots of each base portion are associated with at least one protrusion carried by an adjacent section. The protrusion extends upwardly from the adjacent base section through the arcuate serrated slot. Subsequent deformation of the protrusion precludes pivoting of the adjacent base sections in relation to one another.

Still further, the current invention provides an apparatus for constructing curved structures wherein the apparatus comprises a plurality of sections with each section having a base portion. Each base portion has at least two parallel slots and each slot is associated with a protrusion or upward extending tab carried by an adjacent section. Each slot has a width sufficient to permit pivotal movement of adjacent sections when the tab or protrusion is positioned with the slot. Preferably, each of section of the apparatus has a base portion, a first track portion and a second track portion, the track portions being oppositely positioned and generally parallel such that the track portions and the base portion form a channel.

Additionally, the current invention provides an apparatus for constructing curved structures wherein the pivotal connection of the apparatus provides the ability to "lock in" a desired radius. In this embodiment, the apparatus comprises a plurality of sections, each section having a base portion which carries an eyelet and an eyelet receiving hole. The eyelet receiving hole has a serrated configuration. The sections are pivotally joined to one another when the eyelet of one base portion is positioned and pivotally secured within the eyelet receiving hole of an adjacent base portion. Compression of the eyelet against the serrated edge of the eyelet receiving hole precludes further pivotal movement of adjacent sections.

In another embodiment wherein the pivotal connection provides the ability to "lock in" a desired radius, the apparatus of the current invention comprises a plurality of sections with each section having a base portion carrying an eyelet and an eyelet receiving hole. In this instance, the eyelet receiving hole has at least two tabs defined by radial cuts. Every other tab defined by the cuts is folded up from the base portion. The plurality of sections are pivotally joined to one another when an eyelet of one base portion is positioned and pivotally secured within an eyelet receiving hole of an adjacent base portion. Following positioning at a desired radius, the apparatus is locked into place by compressing the upward folded tabs of the eyelet receiving hole against the eyelet to preclude further pivotal movement of the adjacent section.

In yet another embodiment, the current invention provides an apparatus for forming a curved structure wherein the apparatus comprises integrally joined sections. In the preferred embodiment, the apparatus is prepared from a single piece of construction material. In one preferred embodiment, the integral connection provides a pivotal connection located between track portions forming one side of the apparatus. In another embodiment, the pivotal connection is centrally located on the base portion of the apparatus.

Still further, the current invention provides a method for fixing the shape of a curved structure. The method of the current invention comprises the steps of providing an apparatus having a plurality of pivotally connected sections, each section having a base portion, at least one slot and at least one upwardly projecting member protruding from the base portion through a slot of an adjacent base portion. The apparatus is positioned in a desired radius and the projecting tab is struck with sufficient force to compress the member against the base portion thereby restricting further pivotal movement of the adjacent sections.

It is therefore a general object of the present invention to provide improved apparatus and methods of forming a curved structure. Other and further objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
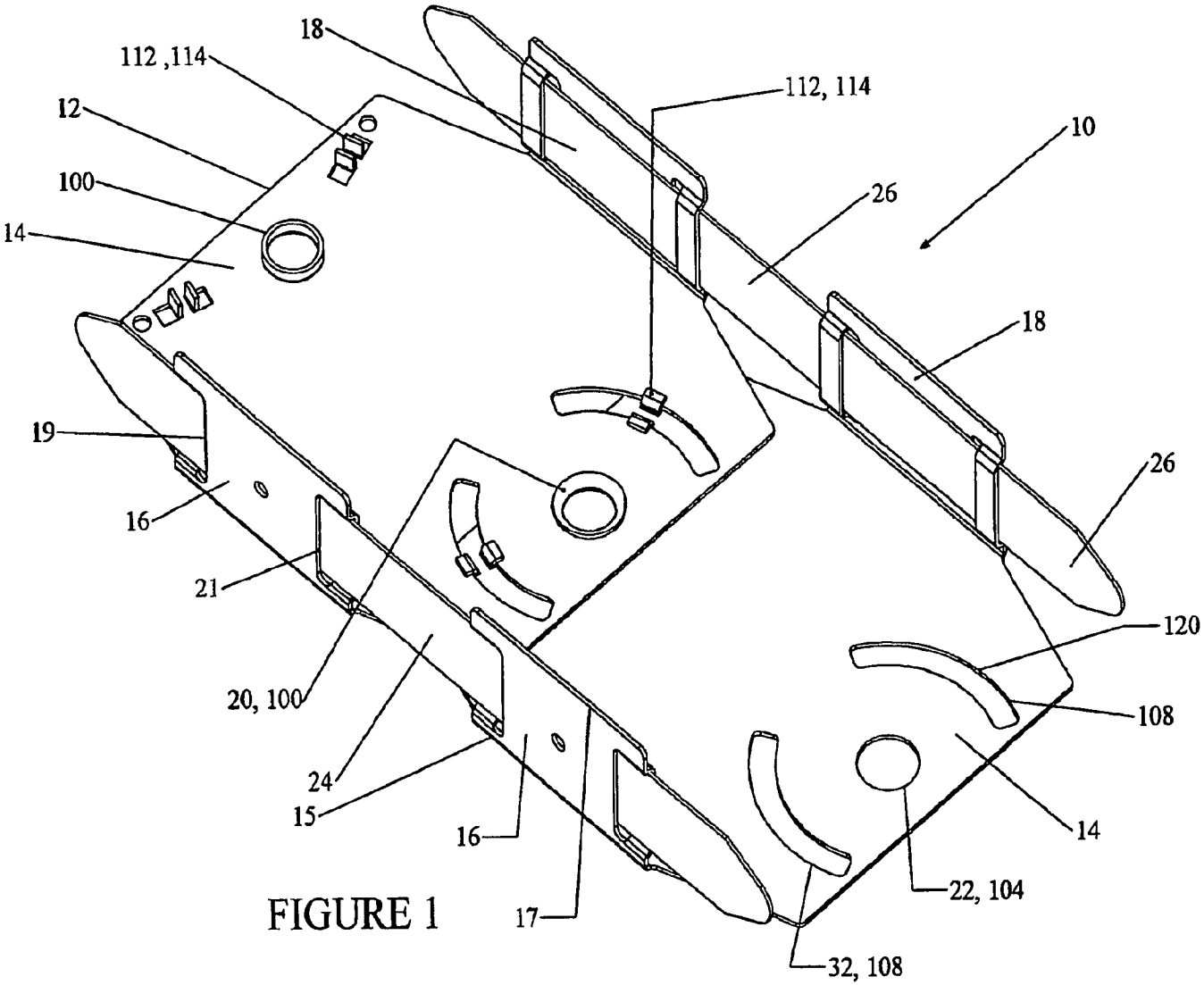
FIG. 1 is a perspective view of one embodiment of the current invention depicting tabs protruding through arcuate slots.

Referring to the drawings, presently preferred embodiments of the invention and their operation are illustrated. Like reference numerals refer to like parts throughout the drawings and this description.

Figure 10:
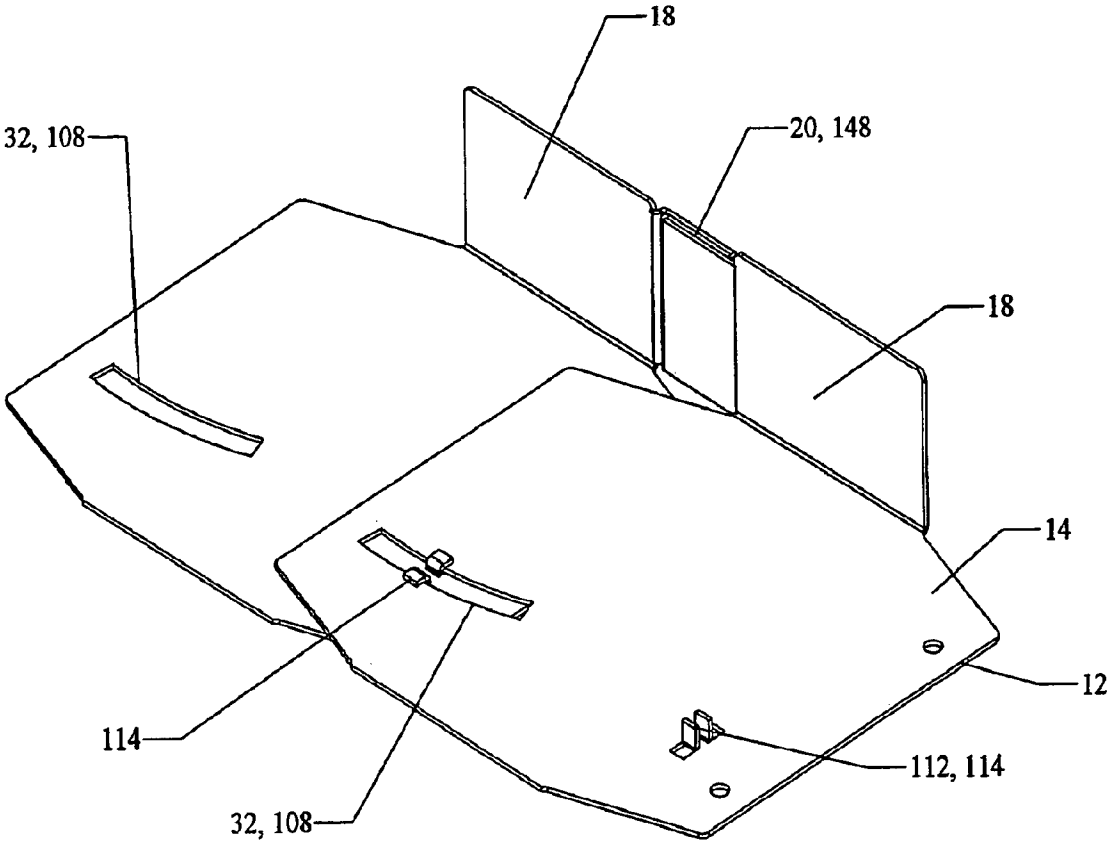
FIG. 10 depicts an alternative embodiment of the current invention wherein adjacent sections pivot in relation to one another using slots and tabs and wherein the sections are integrally formed and joined by a pivotal connection.
Figure 13:
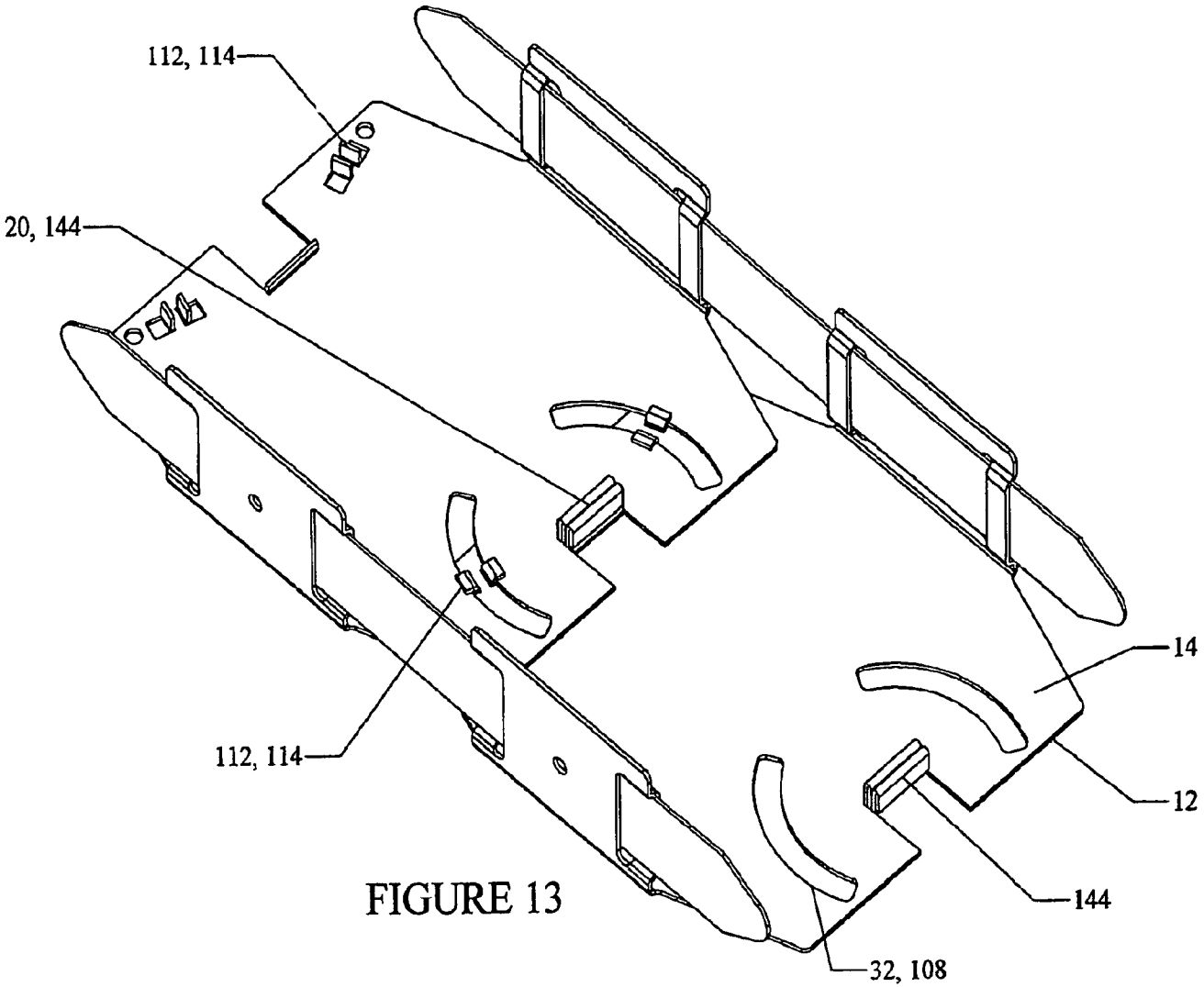
FIG. 13 depicts an alternate embodiment of FIG. 1 wherein the base portions are integrally formed and connected.

Referring to FIG. 1, a presently preferred embodiment of the present invention is illustrated and generally designated by the numeral 10. Apparatus 10 is comprised of a plurality of pivotally connected sections 12. Due to its sectional structure, apparatus 10 can be constructed of virtually any length to fit the desired application. Although the embodiment of FIG. 1 is depicted with discrete sectional components, the current invention also contemplates integrally formed and connected sections 12 as depicted in FIGS. 10 and 13.

In a preferred embodiment, each section 12 has a base portion 14, a first track portion 16 and a second track portion 18. Optional first and second track portions 16, 18 are oppositely positioned near the perimeter of base portion 14. First track portion 16 is oriented generally parallel to second track portion 18. Track portions 16, 18 are oriented generally perpendicular to base portion 14.

Track portions 16, 18 comprise proximate edge 15, which is proximate to base portion 14 and which is formed at the junction of base portion 14 and track portion 16, 18. Track portions 16 further comprise distal edge 17, which is distal in relation to base portion 14. Track portions 16, 18 also comprise first end 19 and second end 21, which are oppositely spaced on the length of track portions 16, 18.

In the preferred embodiments, adjacent sections 12 are pivotal in relation to each other. Preferably, adjacent sections are pivotally joined together by a pivotal connection 20. Pivotal connection 20 may be a screw, rivet, pop rivet, brad or other fastener disposed through a hole 22 in base portion 14 of a section 12 and through a hole 22 in base portion 14 in an adjacent section 12. Additionally, the current invention contemplates a pivotal connection which is integrally formed with sections 12. For example see, FIG. 10 wherein pivotal connection 20 integrally joins adjacent sections 12. Additionally, see FIG. 13, wherein pivotal connection 20 is an integral portion of adjacent base portions 14.

In the example of FIG. 1, each base portion 14 carries an eyelet 100 and an eyelet receiving hole 104. As known to those skilled in the art, by properly securing eyelet 100 within eyelet receiving hole 104 a pivotal connection 20 is formed which permits pivotal movement of adjacent sections in relation to one another. Pivotal connections 20 of this type are advantageous due to the ease and cost efficiency of manufacturing.

As illustrated for example in FIGS. 1, 2, 4, 6, 11-13 and 14, adjacent sections 12 are preferably pivotally connected by pivotal connections 20. Pivotal connections 20 are generally centrally located substantially equidistant between the sides of each section 12, i.e., between first track portion 16 and second track portion 18 in a preferred embodiment.

In the preferred embodiment, apparatus 10 includes strap members 24, 26 which are adapted for slidably engaging track portions 16, 18 of sections 12. The combination of track portions 16, 18 and strap members 24, 26 are only one of many designs suitable for defining a channel for receiving wooden, metal or other suitable studs.

Figure 14:
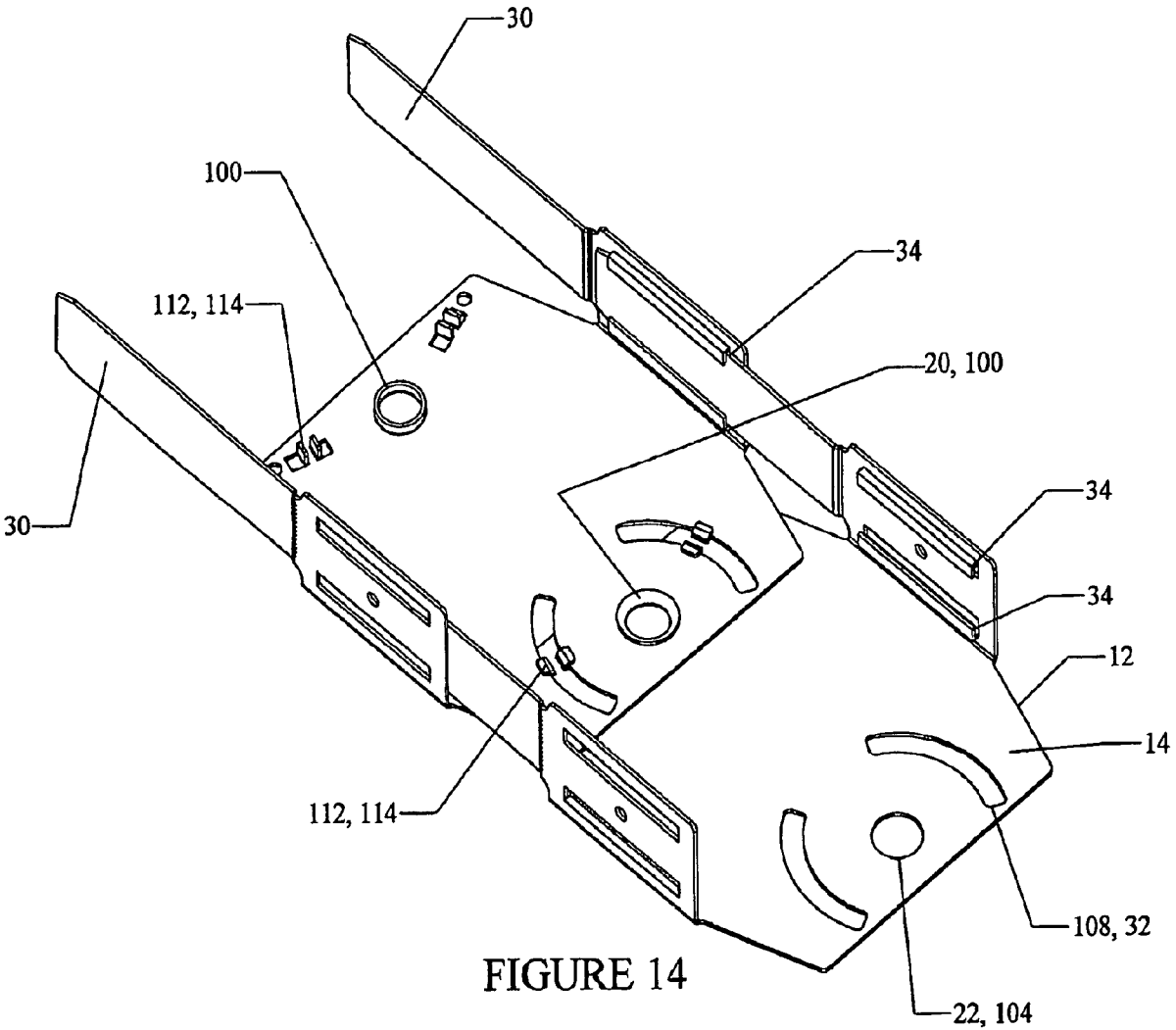
FIG. 14 provides another embodiment of the apparatus of FIG. 1, wherein the strap portion has been replaced by an integral extension carried by each track portion.

Sections 12 move on pivotal connection 20 to form the desired radius of curvature or a variable curve. In a preferred embodiment, apparatus 10 also has a second strap member 26 which is adapted for slidably engaging second track portion 18. When one section 12 is pivoted relative an adjacent section 12, strap members 24, 26 slide relative track portions 16, 18 of a section 12. Those skilled in the art will recognize that strap members 24, 26 may be replaced by integral flange 30 carried by each track portion 16 and 18. As shown in FIG. 14, flange 30 extends from track portions 16 and 18 of each section 12 in a manner sufficient to overlap and preferably contact track portions 16 and 18 of the next adjacent section. More preferably, as shown in FIG. 14, flange 30 engages integrally formed slots 34.

The present invention also provides novel configurations for fixing apparatus 10 in a desired position. In the embodiment depicted in FIG. 1, arcuate slots 108 are generally concentric with pivotal connection 20. Preferably, slots 108 are equidistance from pivotal connection 20. Typically, each section 12 carries two arcuate slots and at least one deformable upwardly projecting member 112. In this embodiment, upwardly projecting member is a tab 114 which extends outward from base portion 14. One skilled in the art will recognize that in certain configurations of the current invention member 112 or tab 114 may project downward or sideways; however, for simplicity, this disclosure will treat member, tab 112, 114 as projecting upwards. Typically, tab 114 will be formed by stamping. Preferably, each section carries at least two tabs 114 and more preferably each section carries four tabs 114. Each section carries tabs 114 on the end opposite of arcuate slots 108. Thus, when assembled, tabs 114 project upwards through slots 108. Following positioning of apparatus 10 in the desired position, tabs 114 are hammered or otherwise compressed against base portion 14 to lock adjacent sections 12 in position relative to one another.

Although FIG. 1 depicts each base portion with two arcuate slots 108, one skilled in the art will recognize that a single arcuate slot 108 will suffice. Further, in the current invention, it is preferred to utilize a metal or other construction material including plastics having a sufficient degree of softness to permit deformation or shearing of the base portion 14 when tabs 114 are compressed against base portion 14. Thus, compression of tabs 114 against base portion 14 will preferably deform base portion 14 in the configuration of tab 114 to physically lock adjacent sections 12 in a position relative to one another.

Figure 2:
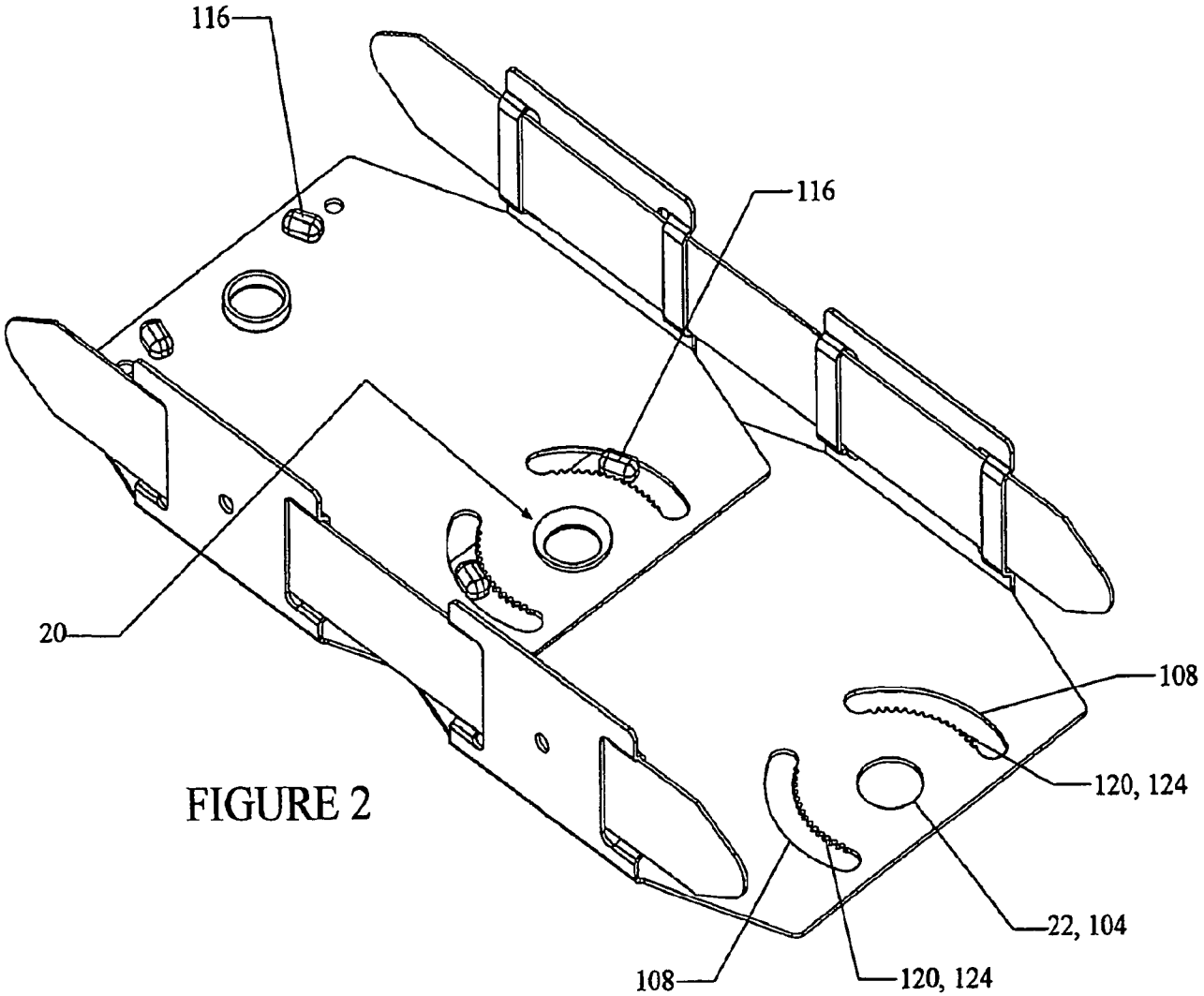
FIG. 2 is an alternative embodiment of the device depicted in FIG. 1 wherein compressible protrusions extend through arcuate slots having serrations.
Figure 3:
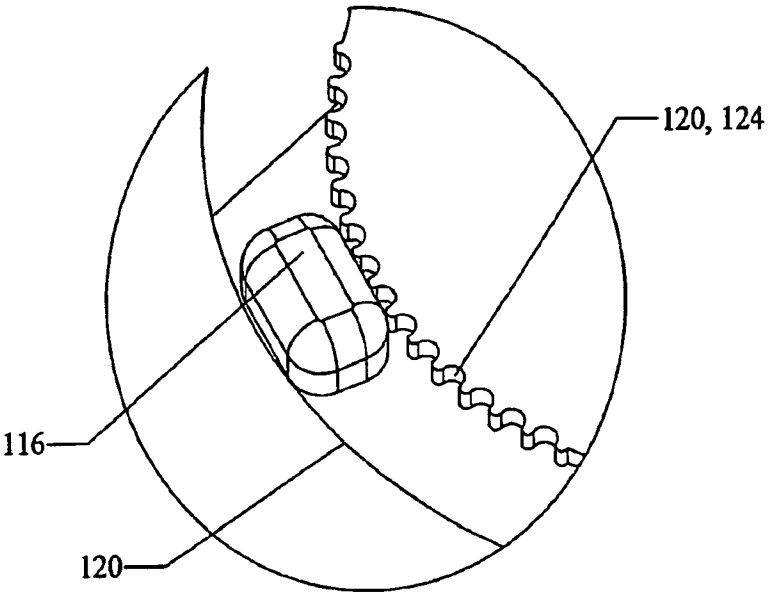
FIG. 3 depicts a close-up view of the protrusion in relation to a serrated edge of an arcuate slot.

FIGS. 2 and 3 depict an alternative embodiment of the current invention. As in FIG. 1, this embodiment of the current invention utilizes at least one and preferably two arcuate slots 108. Also, as in FIG. 1, this embodiment utilizes a pivotal connection 20 formed by securing eyelet 100 within eyelet receiving hole 104.

The embodiment of FIG. 2 differs from the embodiment of FIG. 1 in that upwardly projecting member 112 is a protrusion 116. Protrusion 116 may be formed by any method known to those skilled in the art. Preferably, protrusion 116 is formed by stretching an area of base portion 14 by stamping or other process. At least one and preferably two protrusions 116 are carried by base portion 14 at the opposite end of base portion from arcuate slots 108. Thus, when assembled, protrusions 116 project upwards through slots 108. Following positioning of apparatus 10 in the desired position, protrusions 116 are compressed or swaged to force the expansion of protrusions 116. Once expanded, protrusion 116 engages the sidewalls 120 of slots 108 to preclude further movement of adjacent sections. In the preferred embodiment depicted in FIG. 2, at least one area of sidewalls 120 carries a serrated edge 124. A close-up view of serrated edge 124 is provided by FIG. 3. Serrated edge 124 provides a mechanical locking surface which is engaged by compressed protrusion 116, thereby enhancing the locking capabilities of compressed protrusion 116.

FIG. 13 depicts an alternative pivotal connection 20 suitable for use in the current invention. As depicted in FIG. 13, sections 12 are integrally formed. Typically, a sheet metal stamping process will be used to form apparatus 10. In the embodiment depicted in FIG. 13, pivotal connection 20 is formed by compressing the integral pivotal connection 144 between adjacent sections 12. Following compression, pivotal connection 20 flexes sufficiently to permit pivotal movement between base portions 14. As discussed above, following positioning of apparatus 10, tabs 114 or other upwardly projecting member 112 (not shown) are compressed against base portion 14 to preclude further pivotal movement of sections 12. Thus, this embodiment of the current invention demonstrates the ability to form apparatus 10 from a single piece of construction material.

Figure 4:
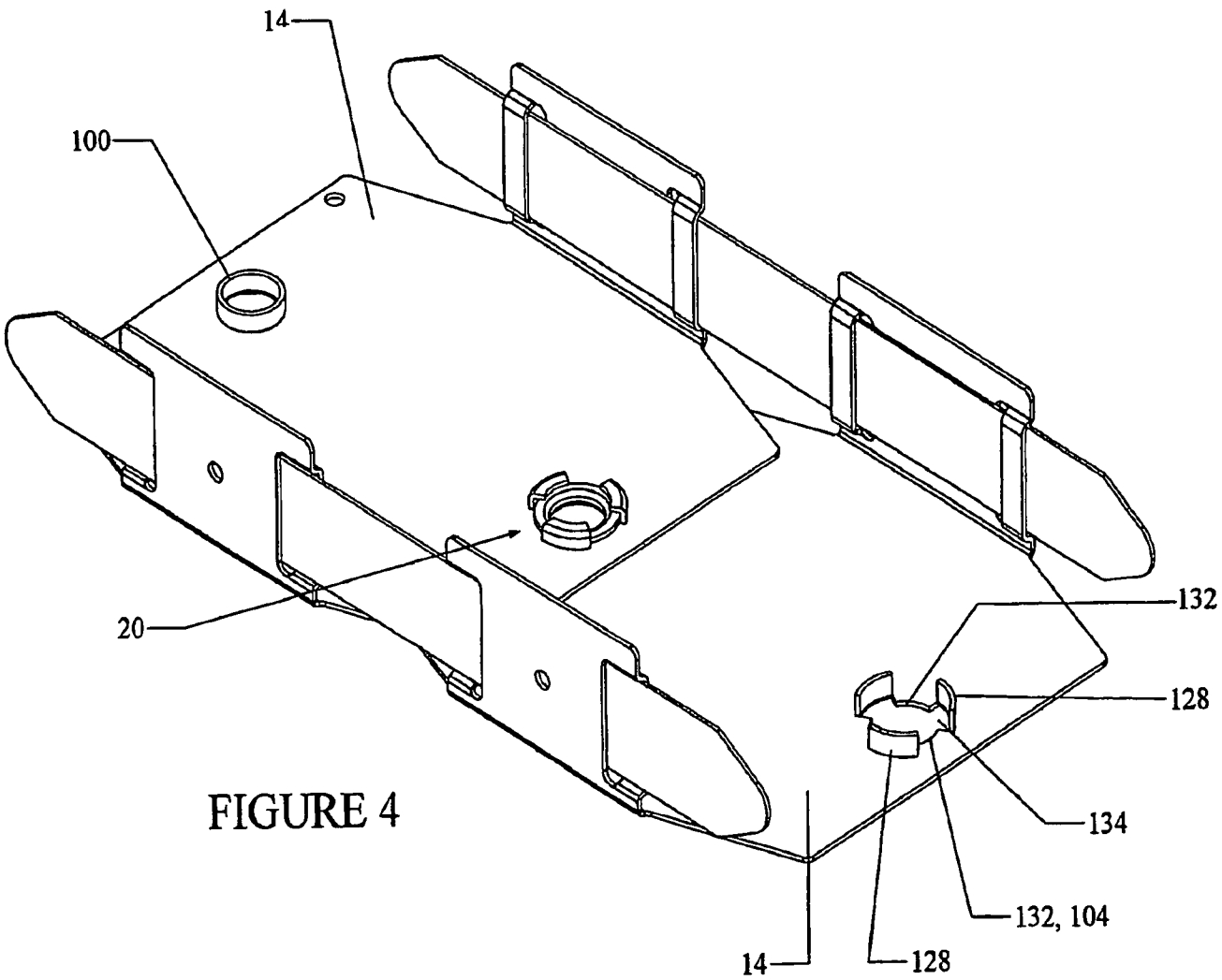
FIGS. 4 and 6 depict further embodiments of the current invention wherein each FIG. depicts a modified eyelet arrangement which provides the ability to pivotally position and subsequently lock adjacent sections.
Figure 5:
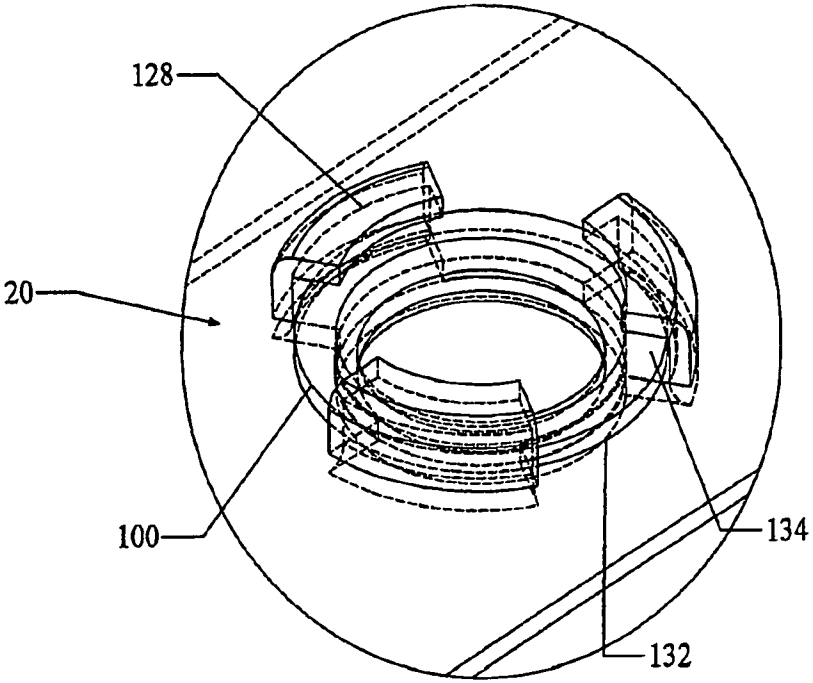
FIGS. 5 and 7 each depict a close-up view of the modified eyelet of FIGS. 4 and 6 respectively.

In another embodiment of the current invention, pivotal connection 20 provides both pivoting and locking capabilities for apparatus 10. FIGS. 4 and 5 depict one arrangement of pivotal connection 20 operating in this manner. While apparatus 10 depicted in FIGS. 4 and 5 also includes track portions 16, 18 and straps 24 and 26, as noted above, other arrangements of apparatus 10 including elimination of one or both track portions 16, 18 will be apparent to one skilled in the art.

In the embodiment of FIGS. 4-7 and 11-12, pivotal connection 20 is preferably a modified eyelet arrangement. As shown in FIG. 4, eyelet receiving hole 104 is characterized by segments 128 and 132. Segments 128 and 132 are initially defined by radial cuts in eyelet receiving hole 104. Eyelet receiving hole 104 and segments 128 and 132 are typically formed by stamping or punching processes known to those skilled in the art.

In the preferred embodiment, at least two segments are formed. More preferably, four segments are formed. As depicted, the most preferred embodiment utilizes six symmetrical segments, three each of segments 128 and 132. Segments 128 are bent upwards while segments 132 remain in their original position to define the diameter of eyelet receiving hole 104.

As depicted in FIG. 4, each base portion 14 carries eyelet receiving hole 104 and eyelet 100 at opposite ends of base portion 14. When initially assembled, eyelet 100 is placed within eyelet receiving hole 104 and swaged or rolled in a manner sufficient to join sections 12 while permitting pivotal movement of adjacent sections 12.

With reference to FIG. 5, during assembly segments 128 are preferably folded over swaged eyelet 100 in a manner which permits continued pivotal movement of adjacent sections. Following position of apparatus 10 in the desired configuration, segments 128 are compressed against eyelet 100 sufficiently to preclude further pivotal movement between adjacent sections 12. Compression of segments 128 may be carried out by crimping, hammering or other technique known to those skilled in the art. Preferably, the compression method applies sufficient force to segments 128 to subsequently produce deformation of eyelet 100 into gaps 134 defined by segments 132. Thus, deformed eyelet 100 mechanically locks adjacent sections 12 together.

Figure 6:
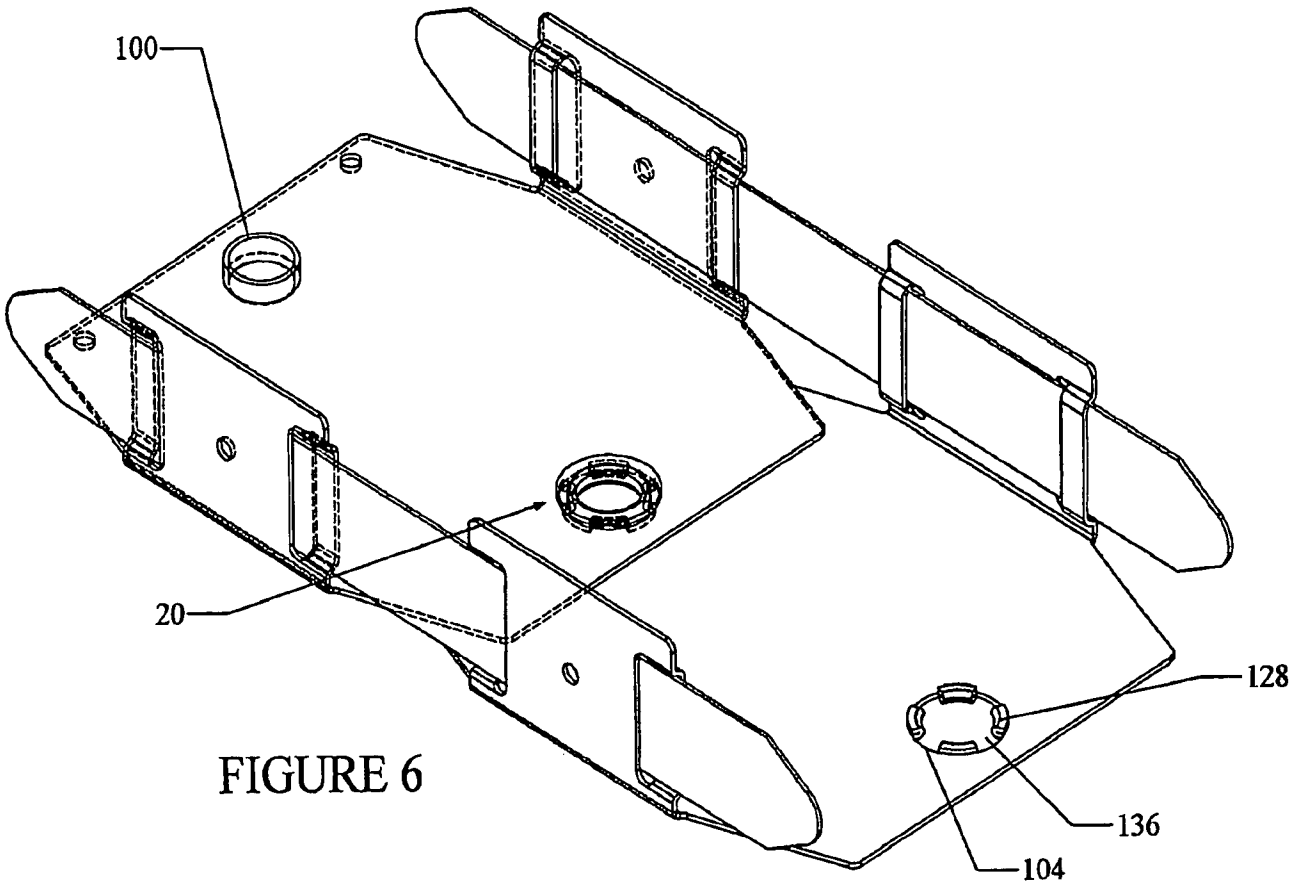
Figure 7:
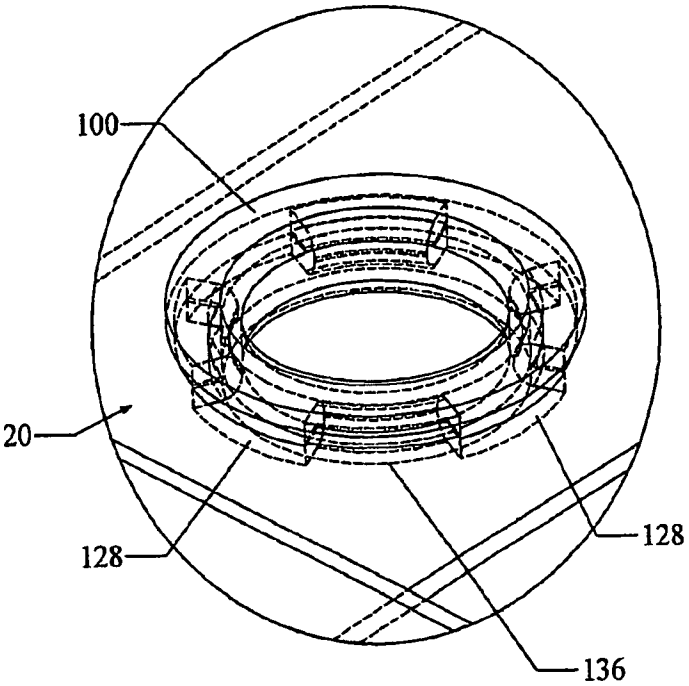

An alternative embodiment of the invention depicted in FIGS. 4 and 5 is provided by FIGS. 6 and 7. In this embodiment of the current invention pivotal connection 20 is a modified eyelet arrangement. In this instance eyelet receiving hole 104 has been modified by initially forming segments 128 and 132; however, in this instance, segments 132 have been removed from eyelet receiving hole 104. Additionally, segments 128 have been folded upwards and backwards to provide an additional layer above base portion 14. Thus, modified eyelet receiving hole 104 has a serrated configuration suitable for enhancing mechanical locking of apparatus 10 in a desired position. In this embodiment of the current invention, eyelet 100 extends upwardly from base portion 14 a sufficient distance to permit conventional swaging, rolling or other suitable technique of eyelet 100 within eyelet receiving hole 104 to produce pivotal connection 20. Following initial assembly of apparatus 10, eyelet 100 is swaged or rolled as discussed above to permit pivotal movement between adjacent sections 12. Once apparatus 10 has been positioned in a desired configuration, eyelet 100 may be further crimped or otherwise compressed against segments 128, thereby securing apparatus 10 in the desired configuration. Preferably, the crimping force applied to eyelet 100 is sufficient to deform eyelet 100 by compressing eyelet 100 into gaps 136 defined by segments 128. Thus, this embodiment of the current invention locks apparatus 10 in the desired configuration by frictional pressure of eyelet 100 against segments 128 and by deformationally locking eyelet 100 in gaps 136.

Figure 11:
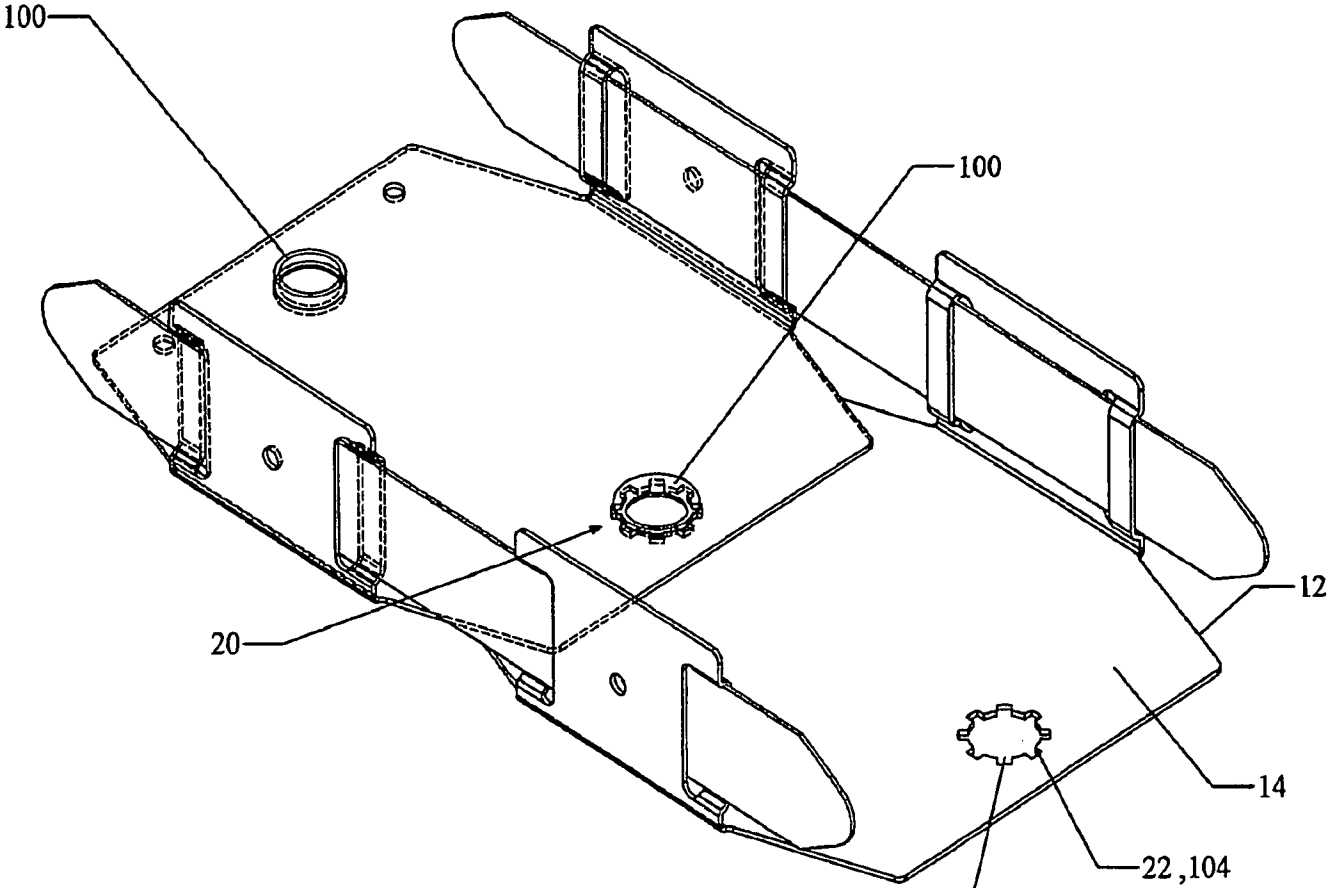
FIGS. 11 and 12 depict a modified pivotal connection wherein an eyelet receiving hole has a serrated configuration.
Figure 12:
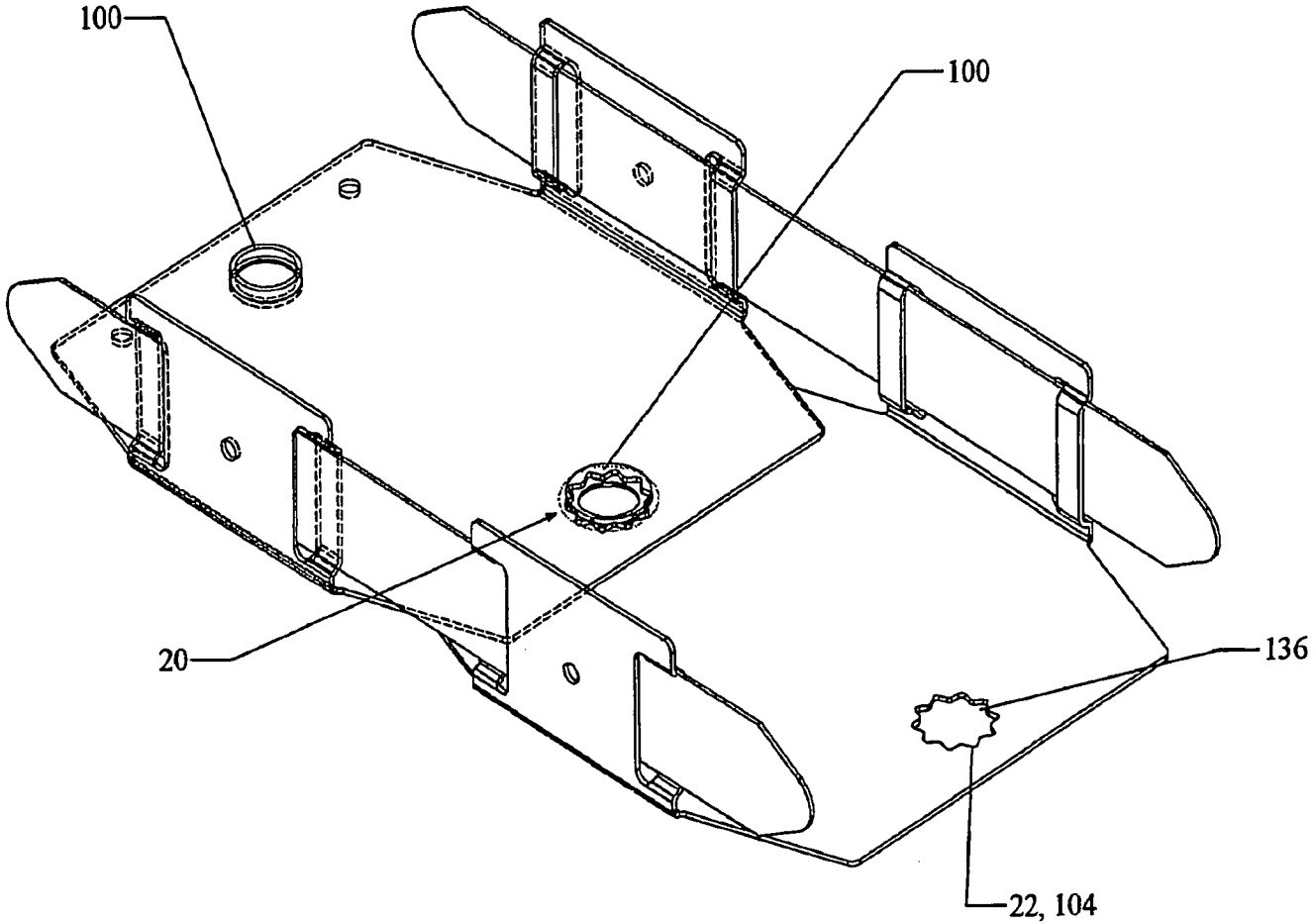

The embodiments depicted in FIGS. 11-12 utilize a modified eyelet receiving hole 104 to enhance the mechanical locking of adjacent sections. As depicted in FIGS. 11-12 eyelet receiving hole 104 may be formed in a variety of geometric patterns. Although generally circular, these patterns provide a tooth liked arrangement which includes gaps 136. Following assembly of each section, eyelets 100 are swaged or otherwise deformed in a manner suitable to secure one section 12 to another while permitting pivotal movement of adjacent sections. Following positioning in a desired arrangement, eyelet 100 is further compressed to preclude further pivotal movement. Preferably, sufficient compressive force is applied to deform eyelet 100 into gaps 136 thereby creating a locking arrangement between eyelet 100 and eyelet receiving hole 104.

Figure 8:
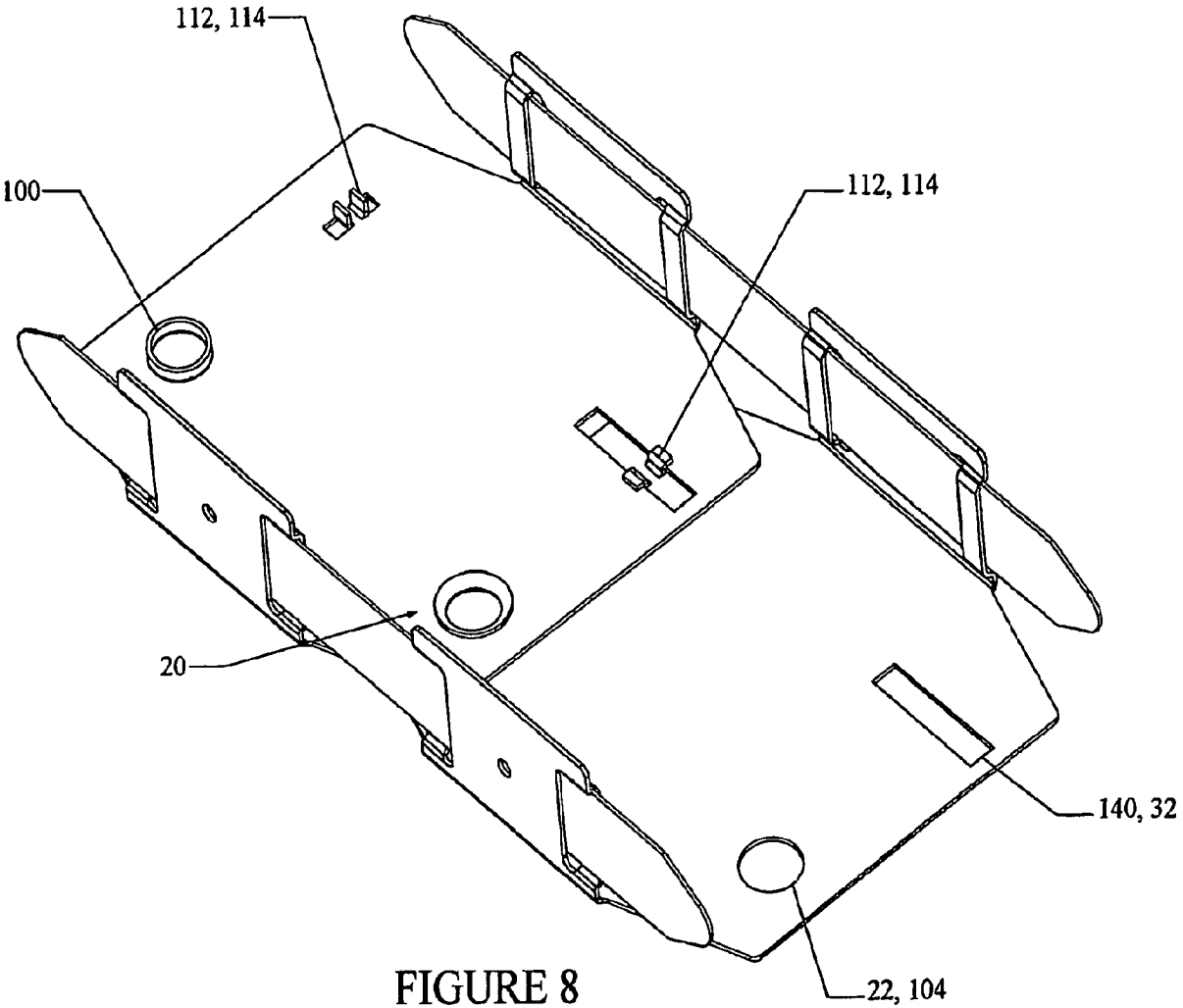
FIG. 8 depicts an alternative embodiment of the current invention wherein the pivot point or pivotal connection is offset from the center of the section.

While the embodiments of FIGS. 4-7 and 11-12 have been depicted with pivotal connection 20 centrally located between tracks 16 and 18, one skilled in the art will recognize that pivotal connection 20 may be offset to either side of base portion 14. For example, in another embodiment of the current invention depicted in FIG. 8, pivotal connection 20 is positioned off center of the central location depicted in FIGS. 1-7. In the embodiment of FIG. 8, base portion 14 carries eyelet receiving hole 104 and eyelet 100 on opposite ends thereof. Additionally, base portion 14 carries at least one tab and preferably two tabs 114. On the opposite end of tabs 114 is a slot 140. When apparatus 10 is assembled, tabs 114 are received within slot 140.

In the embodiment depicted in FIG. 8, slot 140 is a straight slot; however, slot 140 has a width sufficient to permit pivotal movement of adjacent sections 12 on pivotal connection 20. Additionally, a single arcuate slot 108 may be used as depicted for example in FIG. 10 in the embodiment of FIG. 8. When using straight slot 140, tabs 114 are preferably of a length sufficient to permit both tabs to engage base portion 14 when compressed to lock apparatus 10 in the desired configuration. However, engagement of only one tab 114 with base portion 14 will provide satisfactory locking capabilities. Additionally, although not depicted in FIG. 8, one skilled in the art will recognize that the modified eyelet configurations described in conjunction with FIGS. 4-7 will also be useful in the embodiment of FIG. 8 with or without slots 140 and 108.

Figure 9:
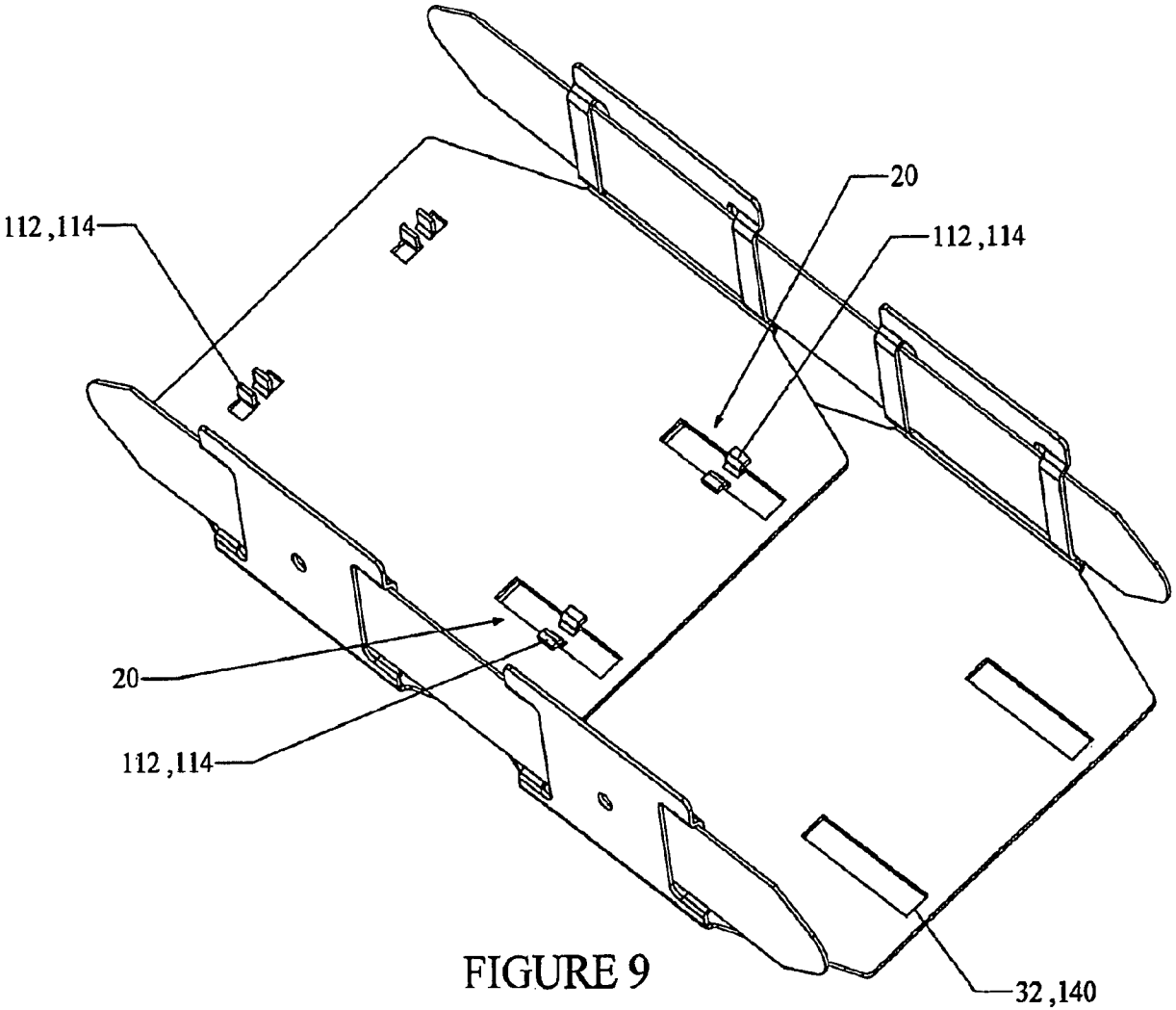
FIG. 9 depicts an alternative embodiment of the current invention wherein slots and tabs provide a slidable pivot and provide subsequent locking of adjacent sections.

A simplified version of the current invention is provided in FIGS. 9 and 10. In the embodiments of FIGS. 9 and 10, single or dual straight line slots 140 or arcuate slots 108 are carried on one end of base portion 14. On the opposite end of base portion 14, at least one tab 114, more preferably paired tabs 114 or protrusions (not shown) are provided. When apparatus 10 is assembled, tabs 114 project upwards through at least one slot 140, more preferably two slots 140 or arcuate slots 108. In the embodiment of FIG. 9, slots 140 have a width sufficient to permit pivotal movement between adjacent sections 12. Further, tabs 114 of FIG. 9 have a length sufficient to permit engagement of base portion 14 following formation of the desired radius of curvature. Thus, each tab 114, when compressed, precludes further pivotal movement of adjacent sections 114. Following arrangement of apparatus 10 in the desired configuration, at least one tab 114 is compressed against base portion 14. Tab 114 may be compressed against base portion 14 by any conventional method known to those skilled in the art. For example, when constructing a curved wall, tab 114 may be struck with a hammer thereby compressing tab 114 against base portion 14.

FIG. 10 also depicts an alternative embodiment of pivotal connection 20. In the embodiment of FIG. 10, pivotal connection 20 is a bendable or flexible integrally formed connection 148. Thus, this embodiment of the current invention demonstrates the ability to form apparatus 10 from a single piece of construction material.

While the embodiments of FIGS. 9 and 10 depict slot 140 a distance from the center of base portion 14, a single slot 140 may be conveniently located centrally between track portions 16, 18. Finally, in the embodiments of FIGS. 9 and 10, tabs 114 are slightly splayed apart following initial assembly of apparatus 10. Thus, prior to compression, tabs 114 in cooperation with slots 140 or 108 may act as pivotal connection 20.

Figure 15:
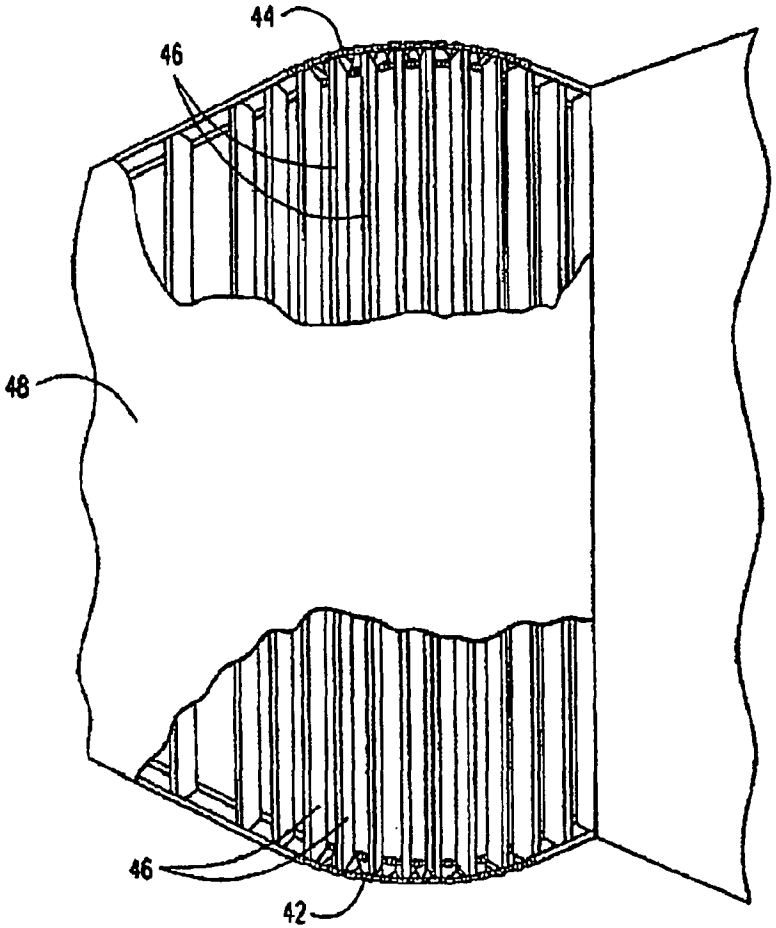
FIG. 15 is a partially sectioned view of a curved wall formed using the apparatus of the present invention.

FIG. 15 illustrates a curved structure formed using the method and apparatus of the present invention. Apparatus 10 provides a first runner 42 and a second runner 44. First runner 42 and second runner 44 are oppositely placed as shown in FIG. 15. Runners 42, 44 are placed in the desired curved position and the radius of curvature of each runner can be fixed or locked as previously discussed herein. Track portions 16, 18 of first runner 42 are substantially aligned with track portions 16, 18 of second runner 44. Runners 42 and 44 can be attached to building structure, i.e., as shown in FIG. 15, first runner 42 is attached to floor structure and second runner 44 is attached to ceiling structure. Runners 42, 44 can be attached to building structure for example by driving nails or fasteners through base portion 14 of sections 12. The present invention will also provide good results when used to construct a curved "floating" wall, i.e., a wall in which runner 44 is not attached to ceiling or other building structure.

Studs 46 are attached between first runner 42 and second runner 44. Studs 46 may be attached, for example, by nails disposed through track portions 16, 18, through strap members 24, 26 and into studs 46. Studs 46 can be formed of wood or metal or other appropriate materials.

Once studs 46 have been attached to runners 42, 44, wall covering or gypsum board 48, such as SHEETROCK™, is attached to studs 46 using, for example, self-tapping dry-wall screws or nails.

Structures other than curved walls can be formed using the same method. For example, a column structure (not shown) can be formed by positioning the first runner in a circle attached to the floor structure, a second runner in a circle attached to the ceiling structure, studs attached between runners 42, 44 and gypsum board 48 attached to studs 46. Curved archways and barrel ceilings can be similarly constructed.

Figure 16:
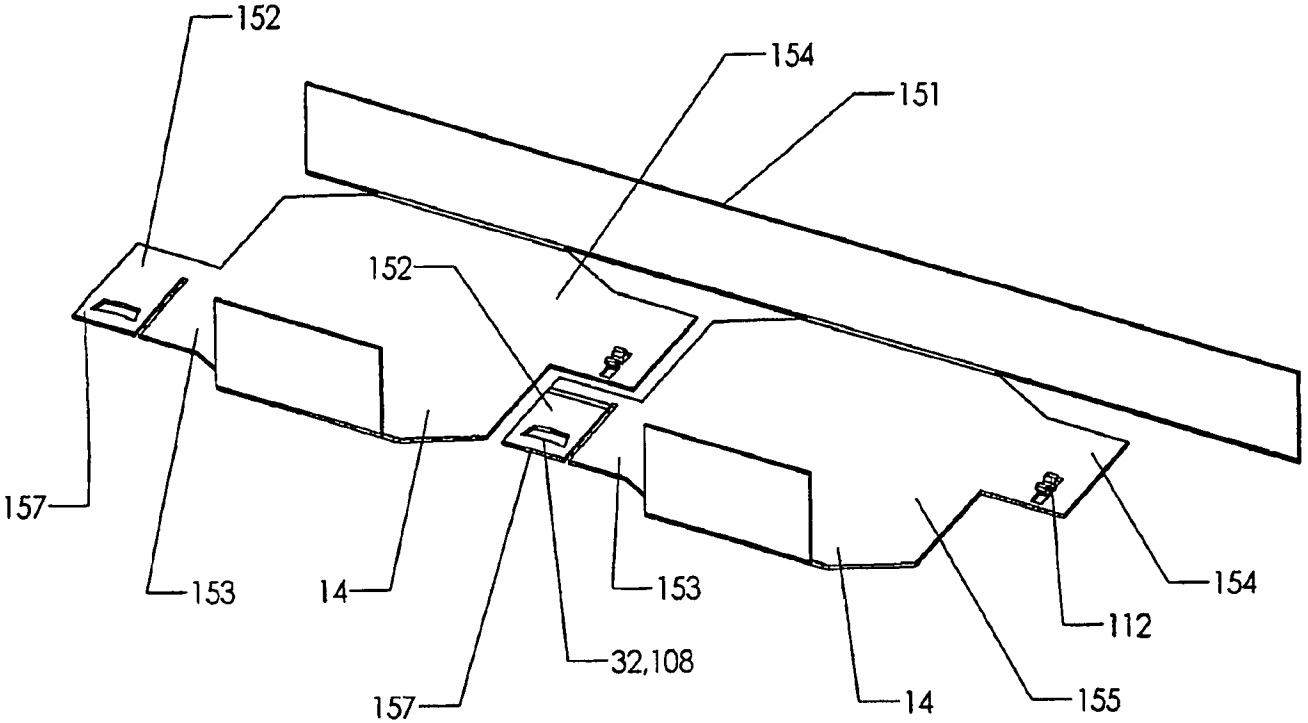
FIGS. 16-17 depict an alternative embodiment of the current invention wherein the base portion carries outwardly projecting tongues with one tongue having a foldable portion.
Figure 17:
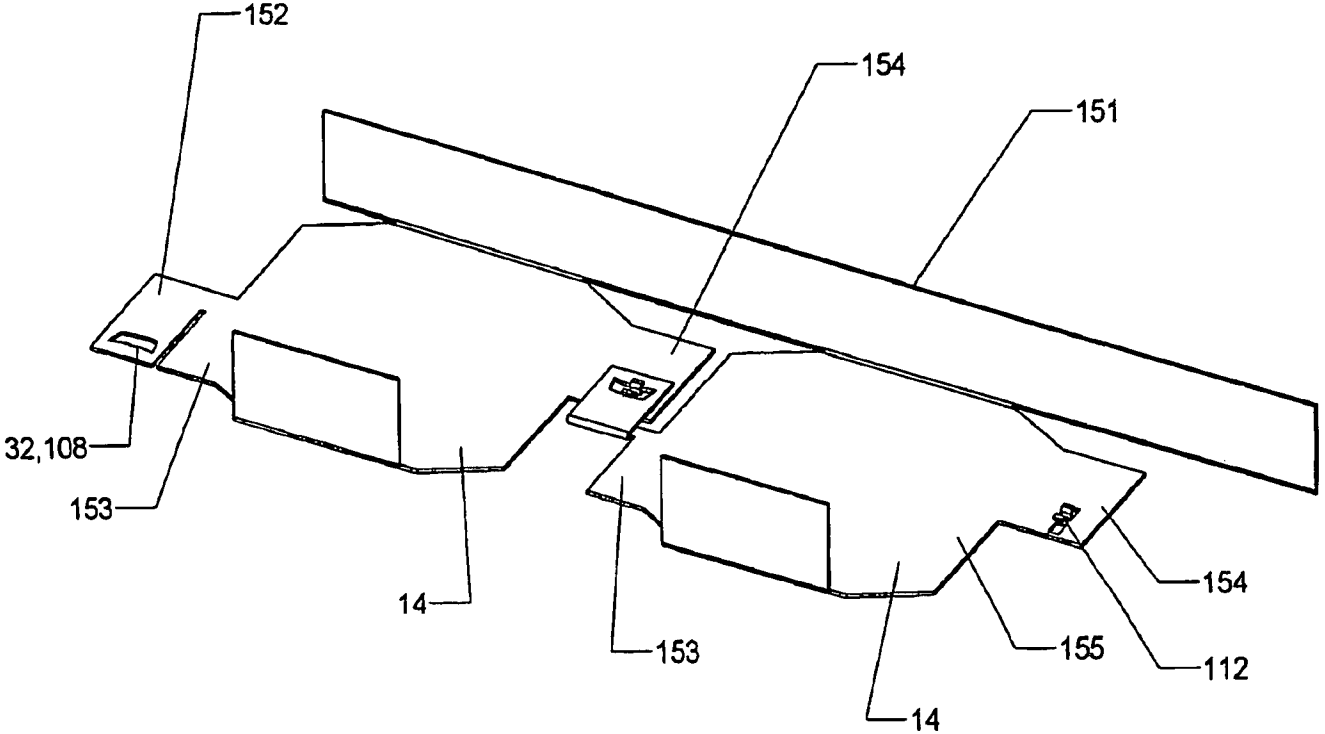

FIGS. 16 and 17 depict a further embodiment of the current invention. In this embodiment, base portion 14 carries an outwardly projecting tongue 152 at one end 153 and an additional tongue 154 at the opposite end 155. Tongue 152 includes a foldable portion 157 carries at least one slot 32. As shown in FIG. 16, foldable portion 157 is provided by cutting a portion of tongue 152 along line 158. Tongue 154 on the opposing end of base portion 14 has at least one and preferably two upwardly projecting members 112 stamped therein. In the preferred embodiment, tongue 154 may have a degree of flexibility but does not have a foldable portion. Preferably, slot 32 is an arcuate slot 108. As depicted in FIGS. 16 and 17 assembly of apparatus 10 entails positioning tongue 152 adjacent to tongue 154, bending foldable portion 157 under or over tongue 154 such that upwardly projecting members 112 align with arcuate slot 108. Upwardly projecting members 112 pass through arcuate slot 108 and permit rotational or pivotal movement of adjacent base portions 14. Following positioning in the desired arc, upwardly projecting members 112 are deformed against base portion 14 thereby securing apparatus 10 in the desired configuration. One skilled in the art will recognize that slot 108 may be carried by the opposite tongue 154 while upwardly projecting members 112 may be carried by foldable portion 157.

Figure 18:
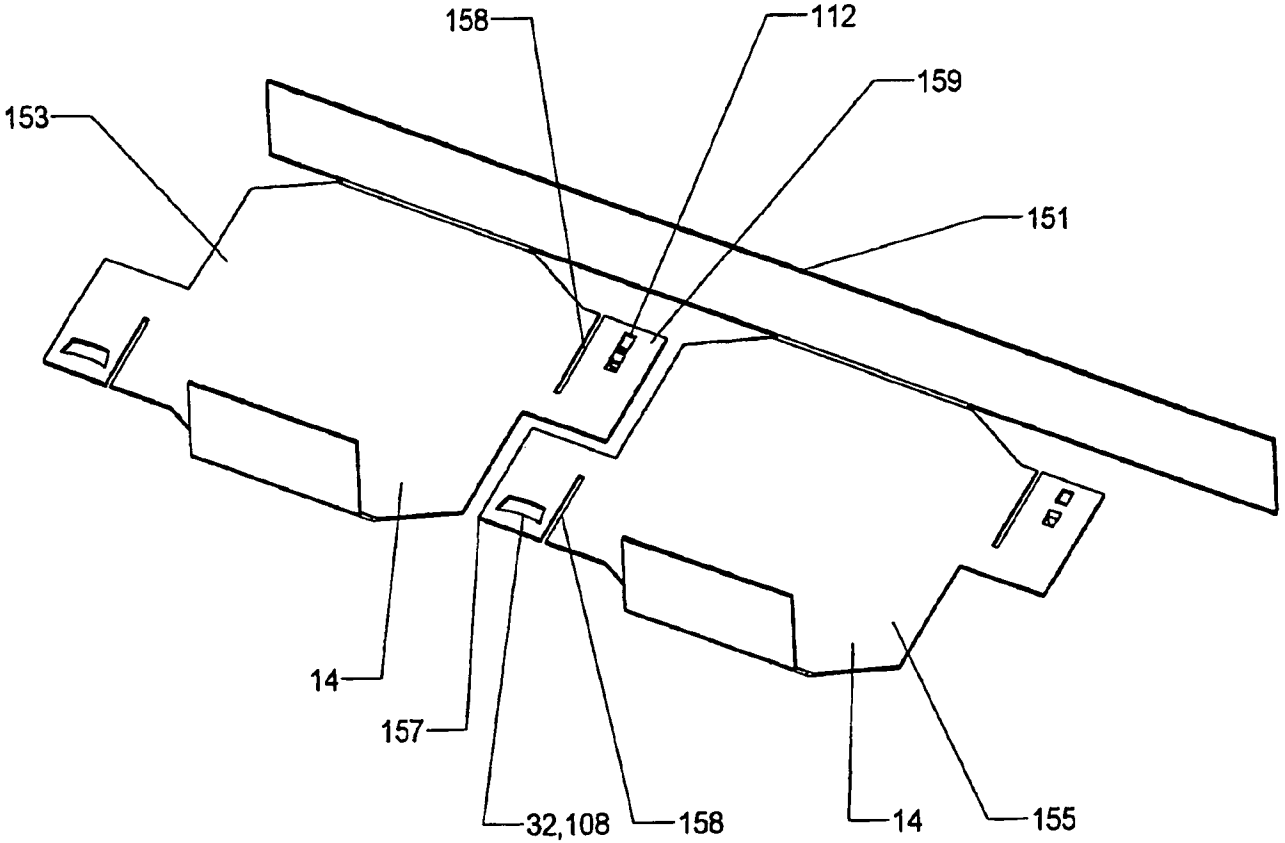
FIGS. 18-19 depict an alternative embodiment of the current invention wherein the base portion carries outwardly projecting tongues with each tongue having a foldable portion.
Figure 19:
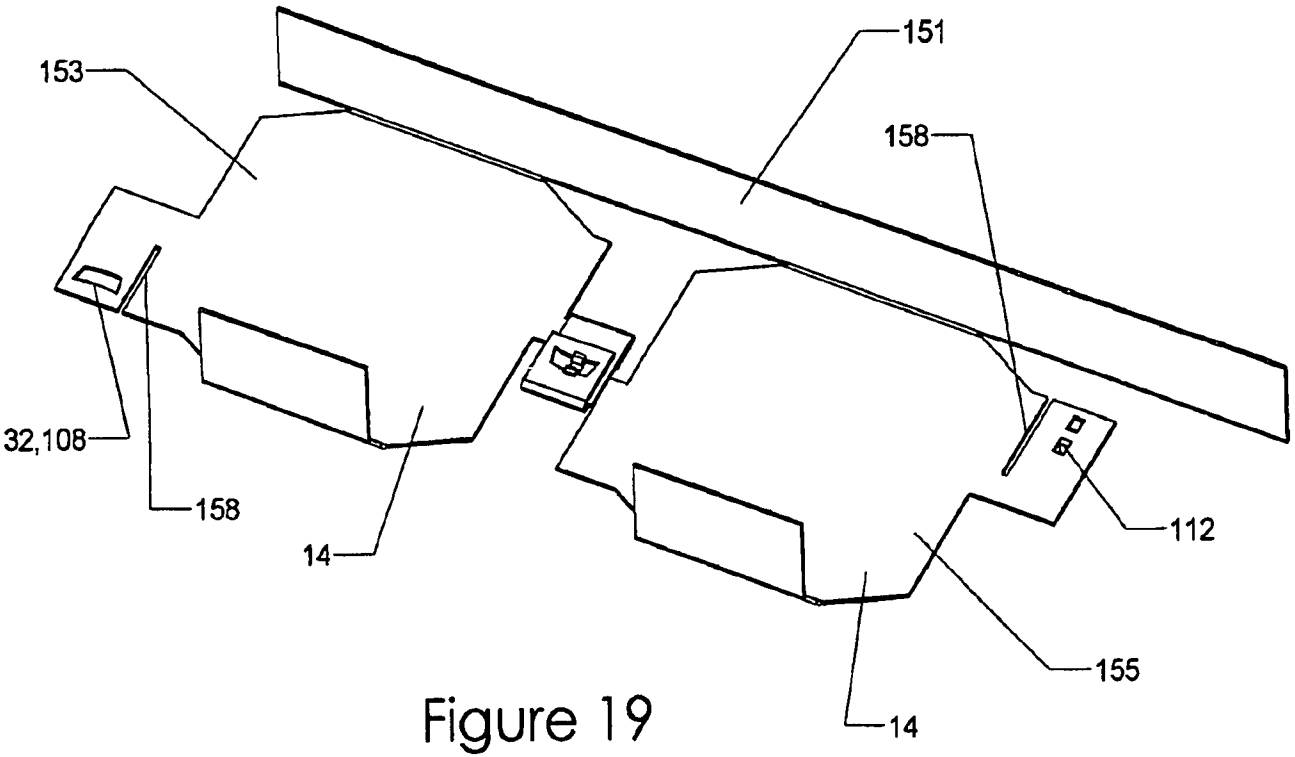

FIGS. 18 and 19 depict another embodiment which is similar to the embodiment of FIG. 16. In FIG. 18, tongue 154 also includes a foldable portion 159. Foldable portion 159 carries at least one and preferably two upwardly projecting members 112 stamped therein. Preferably slot 32 is an arcuate slot 108. Assembly of the embodiment depicted in FIG. 18 entails folding portion 157 up and over tongue 154 and subsequently folding portion 159 up and over portion 157 such that upwardly projecting members 112 are received within slot 32 or arcuate slot 108. The order of folding is not critical. Prior to securing upwardly projecting members 112 against foldable portion 157, adjacent base portions 14 are pivotal in relation to one another. Following positioning in the desired arc, upwardly projecting members 112 are deformed thereby securing apparatus 10 in the desired configuration. One skilled in the art will recognize that slot 108 and upwardly projecting members may be carried by the opposite tongues discussed herein.

Figure 20:
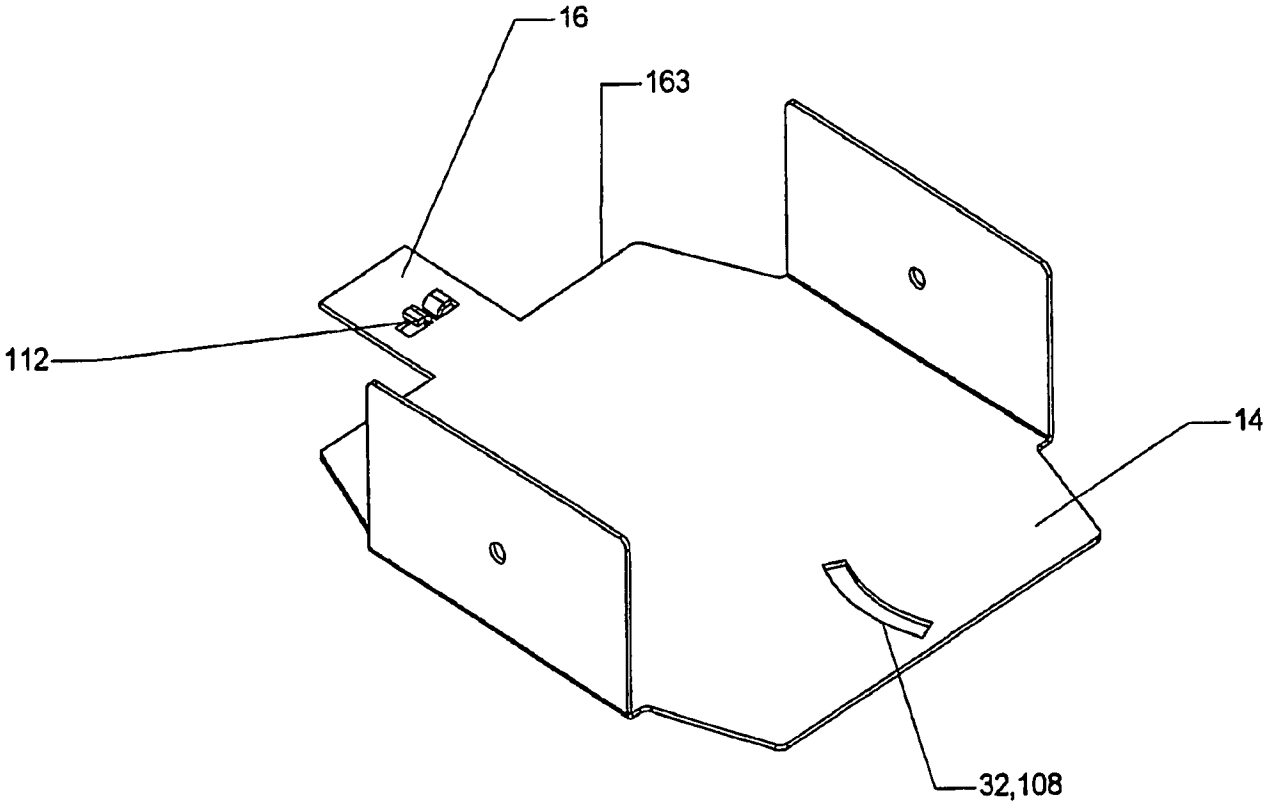
FIGS. 20-22 depict an alternative embodiment of the current invention having a centrally located tongue carried by one end of the base portion of a section while the opposite end of the base portion includes a slot.
Figure 21:
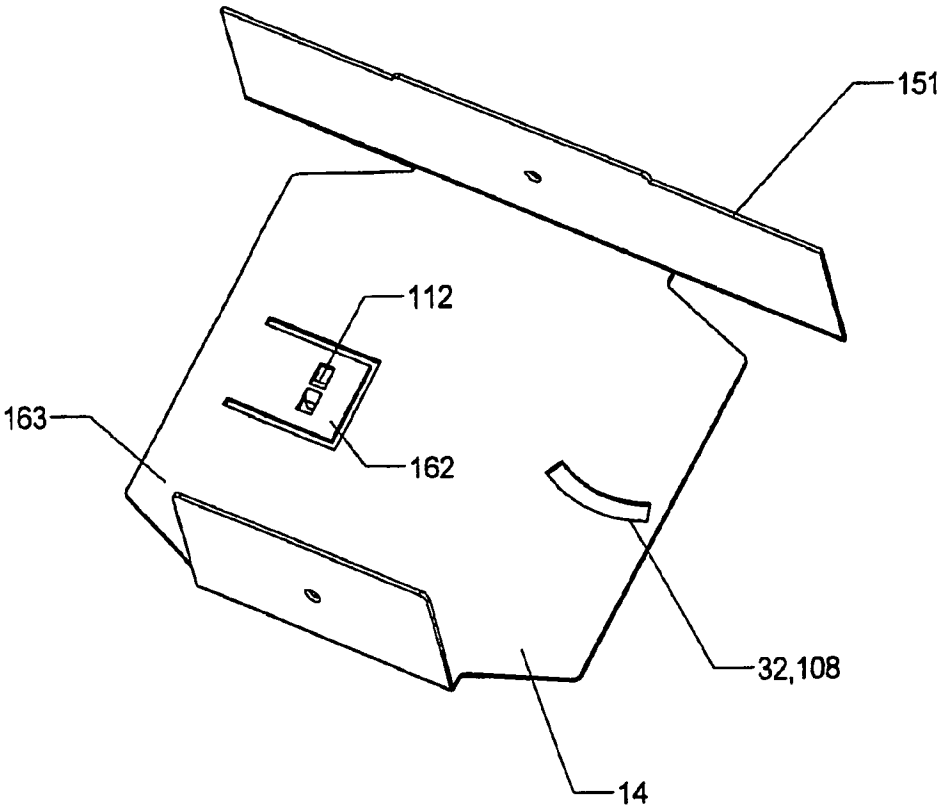
Figure 22:
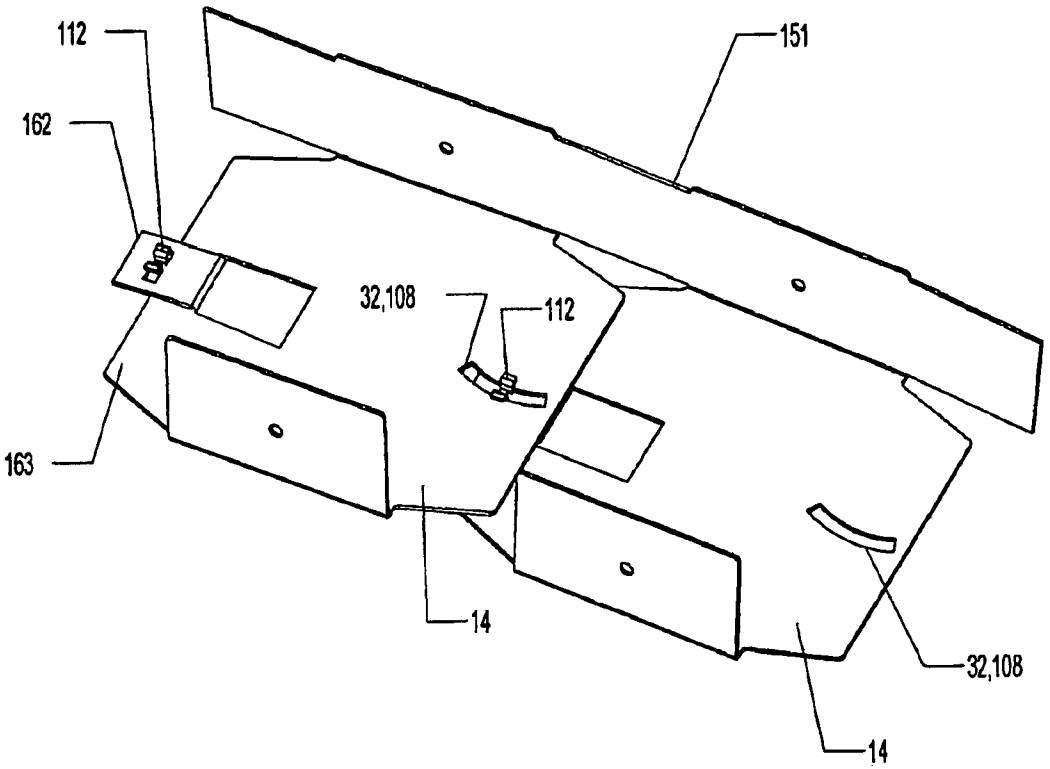

FIGS. 20, 21 and 22 depict yet another alternative embodiment of the current invention. In this embodiment each base portion 14 carries at least one slot 32 and at least one tongue 162. Preferably, slot 32 is an arcuate slot 108. Tongue 162 may be integrally formed with base portion 14 projecting outward from end 163 thereof as depicted in FIG. 20. More preferably, as depicted in FIGS. 21 and 22, tongue 162 is provided by cutting and folding a portion of base portion 14 outward from end 163 as shown in FIGS. 20 and 21. Although shown as in a rectangular configuration, tongue 162 may be generally circular or any other configuration. Tongue 162 carries at least one upwardly projecting member 112. When adjacent sections 12 are assembled, upwardly projecting member 112 protrudes through slot 108. Thus, adjacent sections 12 are pivotal in relation to one another. Once positioned in the desired configuration, upwardly projecting member 112 is hammered or otherwise deformed against base portion 14 to secure apparatus 10 in the desired configuration. Alternatively, tongue 162 may carry slot 108 and base portion 14 may carry upwardly projecting member 112.

With regard to the embodiments of FIGS. 16-21, those skilled in the art will recognize that each section 12 may carry one or two track portions 16, 18, integral flange 30 or strap members 24, 26 as discussed in the earlier embodiments. Further, track portion 16 or 18 in the embodiments of FIGS. 16-21 may include bendable or flexible integrally formed connection 148 as depicted in FIG. 10. Additionally, slots 32 or arcuate slots 108 may have serrated edges. As such, upwardly projecting members 112 may be in the form of tabs 114 or protrusions 116. Alternatively, as depicted in FIGS. 16-19, sections 12 are integrally formed and connected by track portion 151. Track portion 151 has sufficient flexibility to permit formation of an arc. One skilled in the art will recognize that the other configurations of side tracks discussed herein may be readily substituted in these embodiments.

The current invention also provides a method for fixing the shape of a curved structure. In the method of the current invention apparatus 10, as described in any of the embodiments above, is positioned in a desired radius. With reference to FIGS. 1, 8-10, following configuration of apparatus 10, at least one upwardly projecting member 112, e.g. tab 114, is compressed against base portion 14 to preclude further pivotal movement of adjacent sections 12. In the embodiment of FIG. 2, protrusion 116 is deformed sufficiently by a compressive force, e.g. a hammer, to engage sidewall 120 of slot 108. Similarly in FIGS. 4 and 5, segment 128 is compressed or crimped against eyelet 100 to preclude further pivotal movement of adjacent sections 12. Finally, in when using the embodiment of FIGS. 6-7, eyelet 100 is further compressed by crimping or hammering against segments 128 thereby frictionally and deformationally precluding further pivotal movement of adjacent sections 12.

Thus, the present invention is well adapted to carry out the objects and attain the ends and advantages mentioned as well as those inherent therein. While preferred embodiments of the present invention have been illustrated for the purpose of the present disclosure, other embodiments of the current invention will be apparent to those skilled in the art from a consideration of this specification, the drawings or practice of the invention disclosed herein. In particular, one skilled in the art will appreciate the interchangeability of the various components depicted in each of the embodiments disclosed herein. Thus, the foregoing disclosure will enable the construction of a wide variety of apparatus within the scope of the following claims. Accordingly, the foregoing specification is considered merely exemplary of the current invention with the true scope and spirit of the invention being indicated by the following claims.

What is claimed is:

1. An apparatus comprising:

a plurality of sections, each section of the plurality of sections having a base portion, each base portion having at least one arcuate slot and wherein said sections are pivotally joined to one another; and, at least one upwardly projecting deformable member protruding from the base portion of each section, said at least one upwardly projecting member projecting through the arcuate slot of an adjacent base portion; and, said at least one upwardly projecting deformable member being a stamping capable of being compressed against the base portion of an adjacent section of the plurality of sections and when compressed against the base portion of an adjacent section of the plurality of sections further pivotal movement is precluded.

2. The apparatus of claim 1, wherein said base section of the plurality of sections has a sufficient degree of softness to permit shearing thereof upon compression of said upwardly projecting deformable member against said base section, and wherein upon compression, said upwardly projecting deformable member deforms the base portion in the configuration of the foldable member.

3. An apparatus comprising:

a plurality of sections, each section of the plurality of sections having a base portion each base portion having a first end and a second end, said first end having at least two arcuate slots;

said plurality of sections being pivotally joined to one another wherein said sections have a pivot point located between said arcuate slots;

at least one upwardly projecting deformable protrusion member carried by said second end, said at least one upwardly projecting deformable member being received in at least one slot carried by an adjacent base portion; and, said at least one upwardly projecting deformable member being a stamping capable of being compressed against the base portion of an adjacent section of the plurality of sections and when compressed against the base portion of an adjacent section of the plurality of sections further pivotal movement is precluded.

4. The apparatus of claim 3, wherein said base section of the plurality of sections has a sufficient degree of softness to permit shearing thereof upon compression of said upwardly projecting deformable protrusion against said base section, and wherein upon compression, said upwardly projecting deformable protrusion deforms the base portion in the configuration of the foldable member.

5. An apparatus comprising:

a plurality of sections, each section of the plurality of sections having a base portion each base portion having at least two arcuate slots;

said plurality of sections being pivotally joined to one another wherein each section of the plurality of sections has a pivot point located between said arcuate slots; and, at least one upwardly projecting foldable member projecting upwards from said base portion of each section of the plurality of sections through each arcuate slot of an adjacent base portion; and, said at least one upwardly projecting foldable member being a stamping capable of being compressed against the base portion of an adjacent section of the plurality of sections and when compressed against the base portion of an adjacent section of the plurality of sections further movement is precluded.

6. The apparatus of claim 5, wherein said base section of the plurality of sections has a sufficient degree of softness to permit shearing thereof upon compression of said upwardly projecting foldable member against said base section, and wherein upon compression, said upwardly projecting foldable member deforms the base portion in the configuration of the foldable member.

7. An apparatus comprising:

a plurality of sections, each section of the plurality of sections having a base portion, wherein each base portion carries an eyelet, an eyelet receiving hole, at least one upwardly projecting foldable tab and at least one arcuate slot;

said plurality of sections being pivotally joined to one another when said eyelet of one base portion is positioned and pivotally secured within said eyelet receiving hole of an adjacent base portion;

said upwardly projecting foldable tab being received by said arcuate slot of an adjacent base portion; and, said at least one upwardly projecting foldable tab being a stamping capable of being compressed against the base portion of an adjacent section of the plurality of sections and when compressed against the base portion of an adjacent section of the plurality of sections further pivotal movement is precluded.

8. The apparatus of claim 7, wherein said base has a sufficient degree of softness to permit shearing thereof upon compression of said upwardly projecting foldable tab against said base, and wherein upon compression, said upwardly projecting foldable tab deforms the base portion in the configuration of the foldable member.

9. An apparatus comprising:

a plurality of sections, each section having a base portion, wherein each base portion carries an eyelet, an eyelet receiving hole and at least two arcuate slots;

said plurality of sections being pivotally joined to one another when said eyelet of one base portion is positioned and pivotally secured within said eyelet receiving hole of an adjacent base portion, wherein said pivot point defined by said eyelet and eyelet receiving hole is located between said arcuate slots; and, at least one upwardly projecting member projecting upwards from said base portion of the plurality of sections wherein at least one upwardly projecting member protrudes through at least one of said arcuate slots of an adjacent base portion, said at least one upwardly projecting member is capable of being compressed against the base portion of an adjacent section of the plurality of sections and when compressed against the base portion of an adjacent section of the plurality of sections further pivotal movement is precluded.

10. The apparatus of claim 9, wherein said base portion carries at least two upwardly projecting members and wherein each slot receives at least one upwardly projecting member.

11. The apparatus of claim 9, wherein said base portion carries at least two upwardly projecting members and wherein at least one slot receives at least two upwardly projecting members.

12. The apparatus of claim 9, wherein said base section of the plurality of sections has a sufficient degree of softness to permit shearing thereof upon compression of said upwardly projecting deformable member against said base section, and wherein upon compression, said upwardly projecting deformable member deforms the base portion in the configuration of the foldable member.

13. An apparatus comprising:

a plurality of sections, each section of the plurality of sections having a base portion, each base portion having at least one serrated slot, and wherein said sections are pivotally joined to one another;

a deformable protrusion carried by said base portion, said deformable protrusion extending through said serrated slot of an adjacent base portion; and, said deformable protrusion capable of being compressed against the base portion of of an adjacent section of the plurality of sections and when compressed against the base portion of an adjacent section of the plurality of sections further pivotal movement is precluded.

14. An apparatus comprising:

a plurality of sections, each section of the plurality of sections having a base portion, each base portion having at least one arcuate serrated slot, and wherein said sections are pivotally joined to one another;

a deformable protrusion carried by said base portion, said deformable protrusion extending through said serrated slot of an adjacent base portion; and, said deformable protrusion capable of being compressed against the base portion of of an adjacent section of the plurality of sections and when compressed against the base portion of an adjacent section of the plurality of sections further pivotal movement is precluded.

15. An apparatus comprising:

a plurality of sections, each section of the plurality of sections having a base portion;

said plurality of sections being pivotally joined to one another wherein each section of said plurality of sections has a pivot point located between at least two arcuate serrated slots; and, wherein each arcuate serrated slot is associated with at least one protrusion carried by an adjacent section and extending upward from said base section through said arcuate serrated slot, said at least one protrusion capable of being deformed against the base portion of an adjacent section of the plurality of sections and when deformed against the base portion of an adjacent section of the plurality of sections further pivotal movement is precluded.

16. An apparatus comprising:

a plurality of sections, each section of the plurality of sections having a base portion, wherein each base portion carries an eyelet, an eyelet receiving hole and at least two serrated arcuate slots;

said plurality of sections being pivotally joined to one another when said eyelet of one base portion is positioned and pivotally secured within said eyelet receiving hole of an adjacent base portion, wherein said pivot point defined by said eyelet and eyelet receiving hole is located between said arcuate slots;

wherein each arcuate serrated slot is associated with at least one protrusion carried by an adjacent section of the plurality of sections, said protrusion extending upward from said base section through said arcuate serrated slot; and, said protrusion capable of being compressed against the base portion of an adjacent section of the plurality of sections and when compressed against the base portion of an adjacent section of the plurality of sections further pivotal movement is precluded.

17. An apparatus comprising:

a plurality of sections, each section having a base portion, each base portion having at least one slot, wherein said sections are pivotally joined to one another; and, at least one upwardly projecting foldable member protruding from the base portion of each section of said plurality of sections, said upwardly projecting foldable member projecting through the slot of an adjacent base portion and said at least one upwardly projecting foldable member being a stamping capable of being compressed against the base portion of an adjacent section of the plurality of sections and when compressed against the base portion of an adjacent section of the plurality of sections further pivotal movement is precluded.

18. The apparatus of claim 17, wherein said base has a sufficient degree of softness to permit shearing thereof upon compression of said upwardly projecting foldable member against said base.

19. The apparatus of claim 17, wherein said base has a sufficient degree of softness to permit shearing thereof upon compression of said upwardly projecting foldable member against said base, and wherein upon compression, said upwardly projecting foldable member deforms the base portion in the configuration of the foldable member.

20. An apparatus comprising:

a plurality of sections, each section of the plurality of sections having a base portion, wherein each base portion carries an eyelet, an eyelet receiving hole and at least one slot;

said plurality of sections being pivotally joined to one another when said eyelet of one base portion is positioned and pivotally secured within said eyelet receiving hole of an adjacent base portion of the plurality of sections, wherein said pivot point is defined by said eyelet and eyelet receiving hole;

at least one upwardly projecting member protruding from the base portion of each section, said at least one upwardly projecting member projecting through the slot of an adjacent base portion; and, said at least one upwardly projecting member being a stamping capable of being compressed against the base portion of an adjacent section of the plurality of sections and when compressed against the base portion of an adjacent section of the plurality of sections further pivotal movement is precluded.

21. The apparatus of claim 20, wherein said base has a sufficient degree of softness to permit shearing thereof upon compression of said upwardly projecting foldable member against said base.

22. The apparatus of claim 20, wherein said base has a sufficient degree of softness to permit shearing thereof upon compression of said upwardly projecting member against said base, and wherein upon compression, said upwardly projecting member deforms the base portion in the configuration of the foldable member.

23. An apparatus comprising:

a plurality of sections, each section of the plurality of sections having a base portion;

at least one slot carried by said base portion;

an integrally formed pivotal connection joining adjacent sections of the plurality of sections;

at least one upwardly projecting member protruding from the base portion of each section of the plurality of sections, said upwardly projecting member projecting through the slot of an adjacent base portion; and, said upwardly projecting member being a stamping capable of being compressed against the base portion of an adjacent section of the plurality of sections and when compressed against the base portion of an adjacent section of the plurality of sections further pivotal movement is precluded.

24. An apparatus comprising:

a plurality of sections, each section of the plurality of sections having a base portion;

at least one slot carried by said base portion;

at least one track portion carried by said base portion;

said track portion including an integrally formed pivotal connection joining said plurality of sections;

at least one upwardly projecting member protruding from the base portion of each section of the plurality of sections, said upwardly projecting member projecting through the slot of an adjacent base portion said upwardly projecting member being a stamping capable of being compressed against the base portion of an adjacent section of the plurality of sections and when compressed against the base portion of an adjacent section of the plurality of sections further pivotal movement is precluded.

25. An apparatus comprising:

a plurality of sections, each section of the plurality of sections having a base portion;

at least two slots carried by said base portion of each section of the plurality of sections;

wherein each slot is associated with at least one deformable protrusion or upwardly projecting member carried by an adjacent section of the plurality of sections, said deformable protrusion or upwardly projecting member extending through said slot and wherein said slot has a width sufficient to permit pivotal movement between sections; and, said at least one upwardly projecting member or deformable protrusion being capable of being compressed against the base portion of an adjacent section of the plurality of sections and when compressed against the base portion of an adjacent section of the plurality of sections pivotal movement is precluded.

26. The apparatus of claim 25, wherein said base has a sufficient degree of softness to permit shearing thereof upon compression of said upwardly projecting foldable member against said base.

27. The apparatus of claim 25, wherein said base has a sufficient degree of softness to permit shearing thereof upon compression of said deformable protrusion or upwardly projecting member against said base, and wherein upon compression, said deformable protrusion or upwardly projecting member deforms the base portion in the configuration of the foldable member.

28. An apparatus comprising:

a plurality of sections, each of the plurality of sections having a base portion, a first track portion and a second track portion, the track portions being oppositely positioned and generally parallel such that the track portions and the base portion form a channel;

at least two slots carried by said base portion of each section of the plurality of sections;

at least one deformable protrusion or upwardly projecting member carried by said base portion of the plurality of sections and associated with each slot of an adjacent section of the plurality of sections, said deformable protrusion or upwardly projecting member extending through said slot and wherein each slot has a width sufficient to permit pivotal movement between sections when said deformable protrusion or upwardly projecting member is positioned within said slot; and, said at least one deformable protrusion or upwardly projecting member being capable of being compressed against base portion of adjacent section of the plurality of sections and when compressed against the base portion of an adjacent section of the plurality of sections further pivotal movement is precluded.

29. The apparatus of claim 28, wherein said base has a sufficient degree of softness to permit shearing thereof upon compression of said upwardly projecting foldable member against said base.

30. The apparatus of claim 28, wherein said base has a sufficient degree of softness to permit shearing thereof upon compression of said deformable protrusion or upwardly projecting member against said base, and wherein upon compression, said deformable protrusion or upwardly projecting member deforms the base portion in the configuration of the foldable member.

31. An apparatus comprising:

a plurality of sections, each section of the plurality of sections having a base portion, wherein each base portion carries an eyelet and an eyelet receiving hole;

said eyelet receiving hole having a serrated edge;

said plurality of sections being pivotally joined to one another when said eyelet of one base portion is positioned and pivotally secured within said eyelet receiving hole of an adjacent base portion; and, wherein said eyelet capable of being compressed against said serrated edge and when compressed against said serrated edge of said eyelet receiving hole further pivotal movement of said adjacent sections of the plurality of sections is precluded.

32. An apparatus comprising:

a plurality of sections, each section of the plurality of sections having a base portion, wherein each base portion carries an eyelet and an eyelet receiving hole;

said eyelet receiving hole having at least four tabs, said tabs being stampings, wherein every other tab is folded up from said base portion;

said plurality of sections being pivotally joined to one another when said eyelet of one base portion of the plurality of sections is positioned and pivotally secured within said eyelet receiving hole of an adjacent base portion of the plurality of sections; and, said upward folded tabs being capable of being compressed against said eyelet receiving hole an adjacent section of the plurality of sections and when compressed against said eyelet receiving hole of an adjacent section of the plurality of sections further pivotal movement is precluded.

33. The apparatus of claim 32, wherein a portion of said upward folded tabs are folded over said eyelet.

34. An apparatus comprising:

a plurality of sections, each section of the plurality of sections having a base portion, wherein each base portion carries an eyelet and an eyelet receiving hole;

said eyelet receiving hole having at least two tabs defined by radial cuts, wherein every other tab is folded up and back on itself from said base portion;

said plurality of sections being pivotally joined to one another when said eyelet of one base portion of the plurality of sections is positioned and pivotally secured within said eyelet receiving hole of an adjacent base portion of the plurality of sections; and, said eyelet being capable of being against said folded tabs and when compressed against said folded tabs of an adjacent section of the plurality of sections further pivotal movement is precluded.

35. The apparatus of claim 34, wherein said non-folded tabs are shorter than said folded tabs.

36. A method of fixing the shape of a curved structure comprising:

providing an apparatus having a plurality of pivotally connected sections, each section of the plurality of pivotally connected sections having a base portion, at least one slot and at least one upwardly projecting member protruding from said base portion through said arcuate slot of an adjacent base portion;

positioning said apparatus in a desired radius; and, striking said upwardly projecting member of a first section of the plurality of pivotally connected sections protruding through a slot of an adjacent section of the plurality of pivotally connected sections thereby compressing said upwardly projecting member against said base portion of the adjacent section of the plurality of pivotally connected sections to substantially preclude further pivotal movement between the adjacent sections.

37. The method of claim 36, wherein the striking step further comprises interlocking the base portions of adjacent sections.

38. The method of claim 36, wherein each section further comprises:

a first track portion and a second track portion, the track portions being oppositely positioned and generally parallel such that the track portions and the base portion form a channel, the base portions of adjacent sections overlapping;

strap means slidably engaging the first track portion and the second track portion; and pivot means comprising a connection located between the track portions toward each end of the base portion.

39. The method of claim 36, wherein the slot is an arcuate slot.

40. The method of claim 36, wherein said step of striking said upwardly projecting member and compressing said upwardly projecting member against said base applies sufficient force to shear said base portion.

41. The method of claim 26, wherein the step of striking said upwardly projecting member and compressing said upwardly projecting member against the base portion of the adjacent section of the plurality of pivotally connected sections further deforms the base portion of the adjacent section of the plurality of pivotally connected sections in the configuration of the foldable member.

* * * * *